US006752915B2

(12) United States Patent
Arao et al.

(10) Patent No.: US 6,752,915 B2
(45) Date of Patent: Jun. 22, 2004

(54) WEB CONVEYING APPARATUS, AND APPARATUS AND METHOD FOR ELECTRODEPOSITION USING WEB CONVEYING APPARATUS

(75) Inventors: Kozo Arao, Santa Clara, CA (US); Noboru Toyama, Osaka (JP); Yuichi Sonoda, Nara (JP); Yusuke Miyamoto, Kyoto (JP)

(73) Assignee: Canon Kabushiki Kaisha, Tokyo (JP)

( * ) Notice: Subject to any disclaimer, the term of this patent is extended or adjusted under 35 U.S.C. 154(b) by 399 days.

(21) Appl. No.: 09/817,301

(22) Filed: Mar. 27, 2001

(65) Prior Publication Data

US 2001/0040097 A1 Nov. 15, 2001

(30) Foreign Application Priority Data

| | | |
|---|---|---|
| Mar. 28, 2000 | (JP) | 2000-087760 |
| Jul. 4, 2000 | (JP) | 2000-201827 |
| Mar. 16, 2001 | (JP) | 2001-075650 |

(51) Int. Cl.[7] ..... C25D 21/12

(52) U.S. Cl. ..... 205/82; 205/137; 205/138; 205/152; 205/141; 205/333; 204/198; 204/199; 204/202; 204/206; 198/300; 198/301; 226/195; 226/10

(58) Field of Search ..... 198/300, 301; 205/82, 137, 138, 152, 141, 333; 204/198, 199, 202, 206; 226/195, 10

(56) References Cited

U.S. PATENT DOCUMENTS

| | | | | |
|---|---|---|---|---|
| 3,734,371 A | * | 5/1973 | Dorfel | 226/109 |
| 4,014,491 A | * | 3/1977 | Gref et al. | 226/113 |
| 4,485,125 A | | 11/1984 | Izu et al. | |
| 4,664,951 A | | 5/1987 | Doehler | |
| 5,659,229 A | * | 8/1997 | Rajala | 318/6 |

FOREIGN PATENT DOCUMENTS

| | | |
|---|---|---|
| DE | 44 39 889 | 8/1996 |
| DE | 199 18 399 | 11/1999 |
| DE | 100 01 637 | 12/2000 |
| EP | 0 606 731 | 7/1994 |
| JP | 5270710 | 10/1993 |
| JP | 6239508 | 8/1994 |
| JP | 8197124 | 8/1996 |
| JP | 10296317 | 11/1998 |

* cited by examiner

*Primary Examiner*—Wesley A. Nicolas
(74) *Attorney, Agent, or Firm*—Fitzpatrick, Cella, Harper & Scinto

(57) ABSTRACT

The present invention provides a web conveying apparatus for conveying a web while holding the web and applying tension to the web, wherein the conveying apparatus has a plurality of rollers with which the web contacts to be conveyed, and at least one roller of the plurality of rollers has a mechanism for limiting deformation of the web within Y/E, and a web conveying method using a web conveying apparatus for conveying a web while holding the web and applying tension to the web, wherein the conveying apparatus has a plurality of rollers with which the web contacts to be conveyed, and the web is conveyed while the deformation of the web is limited within Y/E by a mechanism that is provided for at least one roller of the plurality of rollers. The apparatus and the method prevent meandering of the web.

29 Claims, 11 Drawing Sheets

WEB CONVEYING APPARATUS, AND APPARATUS AND METHOD FOR ELECTRODEPOSITION USING WEB CONVEYING APPARATUS

BACKGROUND OF THE INVENTION

1. Field of the Invention

The present invention relates to a conveying apparatus for conveying a web (a elongated substrate) used as elements or parts with functional film formed thereon, which is wound up in coil form and handled in the apparatus. The present invention, specifically relates to a web conveying apparatus wherein when a web in coil form is unwound for film deposition and then rewound up in coil form, expansion or wrinkle does not occur at the web edges and the web is conveyed along its predetermined path without strain then wound up in coil form with edge alignment. The present invention also relates to a electrodeposition apparatus and a electrodeposition method using such a web conveying apparatus.

2. Related Background Art

When films are continuously stacked on metal sheet, for example, a steel sheet or a stainless steel sheet, as a substrate, on which solar cells can be formed, a commercially effective production of webs can be performed by making a web into a spool in coil or roll form, passing it through stack deposition process while unwinding the coil for delivery, and rewinding up the web in coil form. However, in order to implement such a mechanism, it is important that a web is conveyed in a stack deposition process without meandering and that wind-up misalignment does not occur in winding up. In particular, when the length of an unwound web is large, even very small convey deviation causes large misalignment at the wind-up portion. It is also difficult to correct a web where misalignment once occurred, in the case of a metal where elastic deformation range is very small.

A conveying system which the invention is directed to, and wherein web misalignment does not occur, is disclosed U.S. Pat. No. 4,485,125 ("Method for continuously producing tandem amorphous photovoltaic cells", Energy Conversion Devices, Nov. 27, 1984). In this invention (refer to FIG. 9 in U.S. Pat. No. 4,485,125), deviation of a web is detected by using a optical-based, light-blocking edge detector, and the output signal is fed back to a servomotor, and output of the servomotor is transmitted through a link mechanism to a wheel gear that is provided on one end face of a roller with being eccentric to the axis of the roller, so that the axis of the roller is tilted and tension applied to the web at one side of the roller is varied with respect to tension at the other side of the roller, so as to axially move the web.

U.S. Pat. No. 4,664,951 ("Method provided for corrective lateral displacement of a longitudinally moving web held in a planar configuration", Energy Conversion Devices, May 12, 1987) suggests to prevent warping or deformation of a web by using a magnet roller to prevent the web from rocking and eliminate deviation of the convey path.

Japanese Patent Application Laid-Open No. 5-270710 ("meandering correction mechanism for web, Toppan Printing Co., LTD., laid opened to public on Oct. 19, 1993) discloses a mechanism wherein web meandering is corrected by varying the direction of a guide roll (the term "roller" in the invention has same meaning as "roll(s)" mentioned in above example for conventional art, and so forth.), or axially moving the roll. In fact, this invention intends to combine varying direction of the guide role and axially moving the roll, which effects easily coarse meandering correction but does not effect easily fine meandering correction, since when the amount of meandering is large, if direction of the guide roll is only changed, wrinkles may occur and meandering correction may not be possible.

Japanese Patent Application Laid-Open No. 6-239508 ("controlling apparatus for web travel", Shin-Oji Paper, laid opened to public on Aug. 30, 1994.) discloses a meandering correction mechanism wherein fixed roles and displacement rolls are combined. This invention intends that when correcting web meandering on the displacement rolls that turn back a web between fixed rolls, relative positioning between the displacement rolls are implemented by a press-contact force regulation mechanism.

Moreover, Japanese Patent Application Laid-Open No. 10-296317 (a metal strip conveying apparatus, made open to public by Nippon Steel on Nov. 10, 1998) describes a method to prevent zigzag movement with combination of a free loop, a pinch roller and a crown roll.

As a related art, Japanese Patent Application Laid-Open No. 8-197124 (a method to control zigzag movement of metal plates) discloses a system to form a catenary and judge zigzag amounts from difference in catenary level at the both ends so as to adjust the zigzag by tilting an axis of a roll. Forming catenaries positively is adopted often in order to adjust velocity in case of conveying metal plates and the like.

Incidentally, in case of forming functional film on a metal web, whether it is CVD method in a vacuum apparatus, a spattering method, a heat evaporation method, or an electrodeposition method being a wet system filming, the relationship with the opposite electrode requires rather serious care. In addition, from the point of view to prevent cut or contamination, etc., it is preferable to cause the filmed surface to avoid contact with a roller, etc. as much as possible. Moreover, it is advisable that sandwiching it with a pair of rollers as often conducted in a rotary press or a rolling apparatus is not adopted from the like point of view.

Thus, as in U.S. Pat. No. 4,485,125, when to convey a web, adopted is such a technique to apply a constant tension between a delivery roller and a wind-up roller so that the object is conveyed with a supporting roller applied from a rear surface of the web (the opposite side of a filmed surface of the function film) in almost all cases. In the case where magnetic SUS, etc. is used as a web, it is also possible to convey in a suspended fashion assisted by a magnet roller as in U.S. Pat. No. 4,664,951. Accordingly, in general, it is not a common practice to form a catenary or "slack" positively as disclosed in Japanese Patent Application Laid-Open No. 8-197124.

The present inventors have tried to produce an electrodeposition apparatus as shown in FIG. 2 and to form an oxide on the web of SUS430. A general configuration as well as operation of the actually produced electrodeposition apparatus is shown in FIG. 2. Moreover, divided and enlarged views thereof are shown in FIG. 3 to FIG. 9. FIG. 2 as well as FIG. 3 to FIG. 9 shares common names and reference numerals for respective portions.

Procedure to film or deposit an electrodeposited film onto the web in which the present apparatus was used will be described with reference to FIG. 2 and FIG. 3 to FIG. 9.

The apparatus roughly breaks down to a wind-off apparatus 2012 to deliver a coiled web, a first electrodeposition vessel 2066 to cause the first electrodeposited film to be processed or deposited, a second electrodeposition vessel 2116 to cause the second electrodeposited film to be deposited or processed, a first circulating vessel 2120 to circulate-supply a heated electrodeposition bath to the first electrodeposition vessel, a second circulating vessel 2222 to circulate-supply a heated electrodeposition bath to the second electrodeposition vessel, a fist discharging vessel 2172 to temporarily store the bath when to discharge the electrodeposition bath in the first electrodeposition vessel, a second discharging vessel 2274 to temporarily store the bath when to discharge the electrodeposition bath in the second electrodeposition vessel, a filter circulation system to clean the bath by removing powder in the electrodeposition bath inside the first electrodeposition vessel (a pipe system linked to the first electrodeposition vessel filter circulation filter 2161), a filter circulation system to clean the bath by removing powder in the electrodeposition bath inside the second electrodeposition vessel (a pipe system linked to the second electrodeposition vessel filter circulation filter 2263), a pipe system to deliver compressed air for bath mixing respectively to the first electrodeposition bath and the second electrodeposition bath (a pipe system with the compressed air introducing orifice 2182 in origin), a pure water shower vessel 2360 to clean a web on which an electrodeposited film was deposited with a shower of pure water, a first warm water vessel 2361 to execute first pure water rinse cleaning, a second warm water vessel 2362 to execute second pure water rinse cleaning, a pure water heating vessel 2339 to supply these warm water vessels with necessary pure warm water, a dryer section 2363 to dry the cleaned web, a wind-up apparatus 2296 to wind up again into a coil form the web which completed film depositing, and a system to discharge steam which is created during an electrodeposition both, a heating stage or a drying state on pure water (exhausting system configured by an exhausting duct 2020 of the electrodeposition water cleaning system or an exhausting duct 2370 of the dryer system).

The web is conveyed sequentially from left to right in the drawings via the wind-off apparatus 2012, the first electrodeposition vessel 2066, the second electrodeposition vessel 2116, the pure water shower vessel 2360, the first warm water vessel 2361, the second warm water vessel 2362, the dryer section 2363 and wind-up apparatus 2296 so that a predetermined electrodeposited film is deposited.

As shown in FIG. 3, a coiled web 2006 which is coiled around the wind-off apparatus web bobbin 2001 is set in the wind-off apparatus 2012, which goes on delivering the web 2006 via the wind-off apparatus delivery control roller 2003, the wind-off apparatus direction change roller 2004 and the wind-off apparatus discharging roller 2005. The coiled web is supplied with an interleaf (slipsheet) being sandwiched to protect a substrate or a layer in the case where an underlining layer is deposited in advance in particular. Therefore, in the case where the interleaf is coiled in, along with wind-off of the web the interleaf 2007 is wound up by a wind-off apparatus interleaf wind-up bobbin 2002. The conveying direction of the web 2006 is indicted by an arrow 2010, the rotating direction of the wind-up apparatus web bobbin 2010 is indicated by an arrow 2009, and the wind-up direction of the wind-off apparatus interleaf wind-up bobbin 2002 is indicated by an arrow 2008. In the drawing, the web discharged from the wind-off apparatus web bobbin 2001 and the interleaf wound up by the wind-off apparatus interleaf wind-up bobbin 2002 respectively indicates that interference has not taken place at a position at the time when conveyance starts and at a position at the time when conveyance ends. The wind-off apparatus in its entirety is configured so as to be covered by the wind-off apparatus clean booth 2011 using a HEPA filter and a down flow for protection against dust.

The first electrodeposition vessel 2066 is, as shown in FIG. 4, held in the first electrodeposition bath holding vessel 2065 that can keep the electrodeposition bath warm without being corrosive to the electrodeposition bath so that the temperature controlled electrodeposition bath will be the first electrodeposition bath bath surface 2025. The position of this bath surface is realized with over flow by the partition provided inside the first electrodeposition bath holding vessel 2065. The not-shown partition is installed so as to drop the electrodeposition bath toward the depth of the first electrodeposition bath holding vessel 2065, and the overflow electrodeposition bath focused to the first electrodeposition vessel overflow return orifice 2024 with a bucket structure reaches the first circulating vessel 2120 via the first electrodeposition vessel overflow return path 2117, and is heated here to flow back again from the first electrodeposition upstream circulation nozzle tube 2063 and the first electrodeposition downstream circulation nozzle tube 2064 to the first electrodeposition bath holding vessel 2065 so as to form inflow of the electrodeposition bath sufficient to urge an overflow.

The web 2006 passes inside the first electrodeposition vessel 2066 via a electrodeposition vessel entrance return roller 2013, a first electrodeposition vessel approach roller 2014, a first electrodeposition vessel withdraw roller 2015, and an inter-electrodeposition return roller 2016. Between the first electrodeposition vessel approach roller 2014 and the first electrodeposition withdraw roller 2015, at least the lower side face of the web being a filmed surface (to be referred to as "front face" in the present specification) is in the electrodeposition bath, opposing 28 units of anodes 2026 to 2053. The actual electrodeposition is executed by giving a negative potential to the web and a positive potential to the anode and by causing an electrodeposition current accompanied by electrochemical reaction to flow between the both parties in the electrodeposition bath.

In an apparatus in FIG. 2, the anode in the first electrodeposition vessel comprises four units each are mounted on seven anode mounting stands 2054 to 2060 (See FIG. 4). An anode mounting stand is structured so that the respective anodes are put via insulating plates and individual potentials are applied from an independent power supply. In addition, the anode mounting stands 2054 to 2060 are assigned to function to hold gaps between the web and the anodes 2026 to 2053 in the electrodeposition bath. Therefore, normally, the anode amounting stands 2054 to 2060 are designed and produced so as to be capable of adjusting height to hold a predetermined gap.

A first electrodeposition vessel rear surface electrode 2061 provided to immediately precede the first electrodeposition vessel withdraw roller 2015 is the one to remove electrochemically the film deposited on the opposite face against the filmed surface of the web (to be referred to as "rear face" in the present specification), and this is realized by taking the first electrodeposition vessel rear face electrode 2061 as the negative side potential against the web. The fact that the first electrodeposition rear face electrode 2061 is actually effective is confirmed in that a film, which is attached electrochemically onto the rear face in the opposite side of the filmed surface of the web by a wrap-around electric field, having the same quality as that of the film formed on the filmed surface of the web, is rapidly removed under visual observation.

To the web having come out from the electrodeposition bath after passing through the first electrodeposition vessel withdraw roller 2015, the electrodeposition bath is applied from the first electrodeposition vessel exit shower 2067 so as to prevent the filmed surface from being dried and giving rise to surface irregularity. In addition, an inter-electrodeposition cover 2019 provided in the bridge portion between the first electrodeposition vessel 2066 and the second electrodeposition vessel 2116 also shuts the steam generated from the electrodeposition vessel and prevent the filmed surface of the web from being dried. Moreover, a second electrodeposition vessel entrance shower 2068 functions to prevent from being dried as well.

The first circulating vessel 2120 is in charge of heating and keeping warm the electrodeposition bath and jet circulation thereof inside the first electrodeposition vessel 2066. As described above, the electrodeposition bath having overflowed in the first electrodeposition vessel 2066 is collected into the first electrodeposition vessel overflow return orifice 2024, passes the first electrodeposition vessel overflow return path 2117, and reaches the first circulation vessel heat storage vessel 2121 via the first electrodeposition vessel overflow return path insulating flange 2118. Inside the first circulation vessel heat storage vessel 2121, eight units the first circulation vessel heaters 2122 to 2129 are provided, and these functions at the time when an electrodeposition bath under room temperature is initially heated or at the time when the electrodeposition bath losing its bath temperature due to circulation is heated again to hold the electrodeposition bath at a predetermined temperature.

Two circulation systems are connected with the first circulation vessel heat storage vessel 2121. That is, one is the first electrodeposition vessel upstream circulation return current system to return from the first electrodeposition vessel upstream circulation nozzle tube 2063 to the first electrodeposition bath holding vessel 2065 via a first circulation vessel electrodeposition bath upstream circulation origin valve 2130, a first circulation vessel electrodeposition bath upstream circulation pump 2132, a first circulation vessel electrodeposition bath upstream circulation valve 2135, a first circulation vessel electrodeposition bath upstream circulation flexible pipe 2136 and a first circulation vessel electrodeposition bath upstream circulation flange insulation pipe 2137 and the other is the first electrodeposition vessel downstream circulation return current system to return from the first electrodeposition vessel downstream circulation nozzle tube 2064 to the first electrodeposition bath holding vessel 2065 via a first circulation vessel electrodeposition bath downstream circulation origin valve 2139, a first circulation vessel electrodeposition bath downstream circulation pump 2142, a first circulation vessel electrodeposition bath downstream circulation valve 2145, a first circulation vessel electrodeposition bath downstream circulation flexible valve 2148 and a first circulation vessel electrodeposition bath downstream circulation flange insulation pipe 2149. The electrodeposition bath returning from the first electrodeposition vessel upstream circulation nozzle tube 2063 and the first electrodeposition vessel downstream circulation nozzle tube 2064 to the first electrodeposition vessel 2066 is caused to flow back as a jet stream from the first electrodeposition vessel upstream circulation nozzle tube 2063 provided in the lower portion of the first electrodeposition bath holding vessel 2065 and the first electrodeposition vessel downstream circulation nozzle tube 2064 via orifices respectively created by piercing the nozzle tubes so as to effectuate the electrodeposition bath exchange inside the first electrodeposition bath holding vessel 2065. The return amounts in the respective circulation return current systems are controlled by a closing level of the first circulation vessel electrodeposition bath upstream circulation valve 2135 or the first circulation vessel electrodeposition bath downstream circulation valve 2145, and further delicate adjustment is controlled by a first circulation vessel electrodeposition bath upstream circulation pump bypass valve 2133 or a first circulation vessel electrodeposition bath downstream circulation pump bypass valve 2141 provided in a bypass system which has been brought into connection by short-circuiting the exit and the entrance of the first circulation vessel electrodeposition bath upstream circulation pump 2132 or the first circulation vessel electrodeposition bath downstream circulation pump 2142. The bypass systems function to prevent cavitation from taking place inside the pumps in the case where the return current amount is made less or at the time when the bath temperature is extremely close to the boiling point. Cavitation under which the bath fluid is boiled and evaporated so that a liquid is no longer deliverable will remarkably shorten the life of the pumps.

In the case where orifices are pierced in the first circulation vessel electrodeposition bath upstream circulation nozzle tube 2063 and the first circulation vessel electrodeposition bath downstream circulation nozzle tube 2064 to form a jet stream, the return current amount is almost determined by the pressure to bring back the bath fluid to the first circulation vessel electrodeposition bath upstream circulation nozzle tube 2063 and the first circulation vessel electrodeposition bath downstream circulation nozzle tube 2064. In order to know this, a first circulation vessel electrodeposition bath upstream circulation pressure gage 2134 and a first circulation vessel electrodeposition bath downstream circulation pressure gage 2143 are provided so that the balance in the return current amounts can be known with these pressure gages. The return current bath fluid amount discharged from the orifices exactly follow the Verneuil's theorem, but with orifices pierced in the nozzle tubes having a diameter of not more than several millimeters the jet stream amount all over the first electrodeposition vessel upstream circulation nozzle tube 2063 to the first electrodeposition vessel downstream circulation nozzle tube 2064 can be treated as a constant in a practical term. Moreover, in the case where the return current amounts are sufficiently large, the bath can be exchanged extremely smoothly so that in spite of rather long first electrodeposition vessel 2066 uniformity of the bath density as well as uniformity of the temperature thereof can be planned effectively. It goes without saying that the first electrodeposition vessel overflow return path 2117 should have this thickness cable of flowing a sufficient return current amount.

The first circulation vessel electrodeposition bath upstream circulation flexible pipe 2136 and the first circulation vessel electrodeposition bath downstream circulation flexible pipe 2148 provided in the respective circulation return current systems are to absorb deformation in pipe systems, and in particular are effective in the case where flange insulation pipes, etc. which are apt to suffer from shortage of mechanical intensiveness against deformation. The first circulation vessel electrodeposition bath upstream circulation flange insulation pipe 2137 and the first circulation vessel electrodeposition bath downstream circulation flange insulation pipe 2149 provided in the respective circulation return current systems cause the first circulation vessel 2120 and the first electrodeposition vessel 2066 to float electrically together with the first electrodeposition vessel overflow return path insulation flange 2118 provided in midway of the first electrodeposition vessel overflow return path 2117. This is based on knowledge of the present inventors that giving up formation of unnecessary current route, that is, prevention of stray currents leads to steady and effective progress of electrochemical filming reaction utilizing electrodeposition currents.

The other circulation return current system, is provided with a bypass return current system configured by a first circulation vessel electrodeposition bath bypass circulation flexible pipe 2146 and a first circulation vessel electrodeposition bath bypass circulation flexible valve 2147 to return to a first circulation vessel heat storage vessel 2121 directly, and this is to be used in the case where bath circulation is desired to be executed without the bath fluid is returned to the first electrodeposition vessel, for example, at the time when temperature rises from room temperature to predetermined temperature and the like. In addition, one circulation return current system from the first circulation vessel is provided with a fluid delivery system reaching to the first electrodeposition exit shower 2067 to apply the electrodeposition bath to the web which has passed the first electrodeposition vessel withdraw roller 2015 and come out from the electrodeposition bath, which leads to the first electrodeposition exit shower 2067 via the first electrodeposition exit shower valve 2150. An electrodeposition liquid spray amount from the first electrodeposition exit shower 2067 is adjusted by adjusting the closing level of the first electrodeposition exit shower valve 2150.

Practically, the first circulation vessel heat storage vessel 2121 is provided with a cover so as to be structured to prevent water from becoming steam and going away. In the case where the bath temperature is high, the temperature of the cover will rise, and therefore consideration of sticking an insulating material and the like is necessary from the point of view of safety.

For removing powder of the first electrodeposition vessel electrodeposition bath, a filter circulation system is provided. The filter circulation system for the first electrodeposition vessel is configured by a first electrodeposition vessel filter circulation return flexible pipe 2151, a first electrodeposition vessel filter circulation return flange insulation pipe 2152, a first electrodeposition vessel filter circulation origin valve 2154, a first electrodeposition vessel filter circulation suction filter 2156, a first electrodeposition vessel filter circulation pump 2157, a first electrodeposition vessel filter circulation pump bypass valve 2158, a first electrodeposition vessel filter circulation pressure switch 2159, a first electrodeposition vessel filter circulation pressure gage 2160, a first electrodeposition vessel filter circulation filter 2161, a first electrodeposition vessel filter circulation flexible pipe 2164, a first electrodeposition vessel filter circulation flange insulation pipe 2165, a first electrodeposition vessel filter circulation valve 2166, a first electrodeposition vessel filter circulation system electrodeposition bath upstream return valve 2167, a first electrodeposition vessel filter circulation system electrodeposition midstream return valve 2168 and a first electrodeposition vessel filter circulation system electrodeposition bath downstream return valve 2169. Along this route, the electrodeposition bath will flow in the direction of the first electrodeposition vessel filter circulation direction 2155, ditto 2162 and ditto 2163. The powder to be removed could be plunged in from outside the machine, or could be formed on the electrode surface or in the bath corresponding with the electrodeposition reaction. The minimum size of the powder to be removed is determined by the filter size of the first electrodeposition vessel filter circulation filter 2161.

The first electrodeposition vessel filter circulation return flexible pipe 2151 and the first electrodeposition vessel filter circulation flexible pipe 2164 absorb deformation of pipes to minimize leakage of liquid from pipe connecting portions, to protect insulation pipes which are inferior in mechanical intensity and to freedom in disposition of components of the circulation system including pumps. The purpose of the first electrodeposition vessel filter circulation return flange insulation pipe 2152 as well as the first electrodeposition vessel filter circulation flange insulation pipe 2165 is to cause the first electrodeposition bath holding vessel 2065 which is floating above the ground earth to float in order to prevent it from dropping onto the ground earth. The first electrodeposition vessel filter circulation suction filter 2156, which is a metal mesh or, so to speak, a "tea strainer", removes a large dusts so as to protect succeeding first electrodeposition vessel filter circulation pump 2157 or the first electrodeposition vessel filter circulation filter 2161. The first electrodeposition vessel filter circulation filter 2161, which plays the main role in this circulation system, is to remove powder mixed in or generated in the electrodeposition bath. The circulation current amount of the electrodeposition bath of the present circulation system is minutely adjusted mainly with the first electrodeposition vessel filter circulation valve 2166 and subsequently with the first electrodeposition vessel filter circulation pump bypass valve 2158 provided in parallel along the first electrodeposition vessel filter circulation pump 2157. In order to make note of the circulation current amount by these valve adjustment, the first electrodeposition vessel filter circulation pressure gage 2160 is provided. Besides the minute adjustment of the current amount, the first electrodeposition vessel filter circulation pump bypass valve 2158 prevents cavitation from taking place at the time when the filter circulation current amount in its entirety is tightened and damaging the first electrodeposition vessel filter circulation pump 2157.

The electrodeposition bath can be transferred from a first electrodeposition vessel draining valve 2153 to the fist discharging vessel 2172 via the first electrodeposition vessel filter circulation return flange insulation pipe 2152. This transfer is executed at the time of electrodeposition bath exchange, maintenance of the apparatus or emergency. The electrodeposition bath as the transferred waste fluid is caused to drop into the first waste fluid vessel waste fluid storage vessel 2144 by way of gravitational drop. For maintenance or emergency, the first waste fluid vessel waste fluid storage vessel 2144 preferably has a capacity that can store to fulfill at least the total of the bath capacity of the first electrodeposition vessel 2066 and the first circuit vessel 2120. The first waste fluid vessel waster fluid storage vessel upper cap 2277 is installed in the first waste fluid vessel waste fluid storage vessel 2144, and in order to effectuate gravitational dropping transfer of the electrodeposition bath, a first waste fluid vessel air-bleeder 2171 as well as a first waste fluid vessel air vent valve 2170 is provided. The electrodeposition bath temporarily having dropped into the first waste fluid vessel waste fluid storage vessel 2144 loses temperature, and thereafter is brought into waste water treatment at the building side from the first waste fluid vessel waste water valve 2173, or is collected into a now shown drum can via a first waste liquid vessel waste fluid collection valve 2174, a waster fluid collection origin valve 2175, a waste fluid collection suction filter 2176 and a waste liquid collection pump 2177 so as to be properly disposed. Prior to collection or treatment, it is possible that dilution with water and treatment by way of a chemical liquid, etc. are executed inside the first waste fluid vessel waste fluid storage vessel 2144.

In order to uniform electrodeposition filming by stirring the electrodeposition bath, air bubbles are arranged to be gushed out from a plurality of orifices pierced in the first electrodeposition vessel stirring air introducing tube 2062 installed in the bottom portion of the first electrodeposition bath holding vessel 2065. The air, which is compressed air supplied to a factor, is taken in from the compressed air introducing orifice 2182, and reaches the first electrodeposition vessel stirring air introducing tube 2062 via an electrodeposition bath stirring compressed air pressure switch 2183, sequentially passing in the direction indicated to the first electrodeposition vessel compressed air introducing direction 2184, a first electrodeposition vessel compressed air origin valve 2185, a first electrodeposition vessel compressed air current amount meter 2186, a first electrodeposition vessel compressed air regulator 2187, a first electrodeposition vessel compressed air mist separator 2188, a first electrodeposition vessel compressed air introducing valve 2189, a first electrodeposition vessel compressed air flexible pipe 2190, a first electrodeposition vessel compressed air insulation pipe 2191, and a first electrodeposition vessel compressed air upstream side control valve 2193 or a first electrodeposition vessel compressed air downstream side control valve 2192.

The web conveyed to the second electrodeposition vessel 2116 via the inter-electrodeposition return roller 2016 undergoes deposition of a second electrodeposited film or treatment. Variety of usage of the present apparatus will enable combinations such as that the second electrodeposited film may be the same as the first electrodeposited film to form one film with the first electrodeposited film and the second electrodeposited film, in addition, in spite of adopting the same quality, may be two-layer lamination provided with different characteristics (for example, lamination of layers different in particle size for zinc oxide), or in spite of adopting the same characteristics, may be two-layer lamination provided with different quality (for example, lamination of indium oxide as a transparent electroconductive film and zinc oxide), or may be a lamination of completely different two layers, and moreover, low oxide is deposited in the first electrodeposition vessel 2066 while treatment to proceed with oxidation in the second electrodeposition vessel 2116 is executed, or oxide is deposited in the first electrodeposition vessel 2066 while corrosive carving treatment in the second electrodeposition 2116 is executed. Accordingly, conditions on electrodeposition or treatment such as electrodeposition bath or treatment bath, bath temperature, bath circulation amount, electric current density and stirring amount and the like are selected to comply with respective objects. In the case where time of electrodeposition or treatment for the first electrodeposition vessel 2066 needs to be different from those for the second electrodeposition vessel 2116, change in the conveyance time of the web 2006 to be different from that for the second electrodeposition 2116 will do, for the purpose thereof, change in length of vessel for the first electrodeposition vessel 2066 to be different from that for the second electrodeposition vessel 2166 is done, or the web is returned for adjustment.

The second electrodeposition vessel 2116 is held as shown in FIG. 5 in the second electrodeposition bath holding vessel 2115 that can keep the electrodeposition bath warm without corrosion against the electrodeposition bath so that the temperature controlled electrodeposition bath will become the second electrodeposition bath bath surface 2025. The position of this bath surface is realized by overflow by way of a partition provided inside the second electrodeposition bath holding vessel 2115. The not shown partition is installed so as to drop the electrodeposition bath to the direction of depth in the second electrodeposition bath holding vessel 2115 in its entirety, and the overflowed electrodeposition bath collected into the second electrodeposition vessel overflow return orifice 2075 with a gutter structure reaches the second circulation vessel 2222 via the second electrodeposition vessel overflow return path 2219, and here is heated so as to be returned again to the second electrodeposition bath holding vessel 2115 from the second electrodeposition vessel upstream circulation nozzle tube 2113 as well as the second electrodeposition vessel downstream circulation nozzle tube 2114 to form inflow of electrodeposition bath sufficient to urge overflow.

The web 2006 passes through an electrodeposition inter-vessel shuttle roller 2016, a second electrodeposition vessel entry roller 2069, a second electrodeposition vessel withdrawal roller 2070 and a pure water shower vessel shuttle entry roller 2279 into the second electrodeposition vessel 2116. Between the second electrodeposition vessel entry roller 2069 and the second electrodeposition vessel withdrawal roller 2070, the web surface is present in electrodeposition bath and faces 28 second electrodeposition vessel anodes 2076 to 2103. The actual electrodeposition is carried out by giving negative and positive potentials to the web and the anodes, respectively, to let an electrodeposition current entailing an electrochemical reaction flow between them in the electrodeposition bath.

With the apparatus of FIG. 2, anodes in the second electro-deposition vessel are placed on seven second electrodeposition vessel anode placement stand 2104 to 2110 four for each (See FIG. 5). Each anode placement stand is so structured as to take its respective anodes on it via an insulating plate and is so arranged that a peculiar potential is applied to it from an independent power supply. Besides, the anode placement stands 2104 to 2110 also function to keep an interval between the web and the anodes 2076 to 2103 in the electrodeposition bath. For this purpose, normally, to maintain a predetermined interval, the anode placement stands 2104 to 2110 are so designed and fabricated as capable of height adjustment.

The second electrodeposition vessel back face electrode 2111 provided in direct front of the second electrodeposition vessel exit roller 2070 serves to electrochemically remove the film deposited on the back face of the web in the vessel, which purpose is implemented by setting the second electrodeposition vessel electrode 2111 to a negative electrode relative to the web as with the first electrodeposition vessel electrode 2061.

To the web coming out through the second electrodeposition vessel withdrawal roller 2070 from the electrodeposition bath, the electrodeposition bath is applied from the electrodeposition vessel outlet shower 2297 and prevents the unevenness from occurring due to the drying of the formed film surface. In addition, a pure water shower vessel shuttle entry roller cover 2318, which is provided at a connecting portion between the second electrodeposition vessel 2116 and the pure water shower vessel 2360, confines the vapor generated from the electrodeposition bath to prevent the formed film surface of the web from being dried. Furthermore, a pure water shower vessel inlet surface pure water shower 2299 and a pure water vessel inlet back face pure water shower 2300 also perform a similar action in addition to washing away the electrodeposition bath.

The second circulation vessel 2222 bears the heating or keeping warmth and current circulation of the electrodeposition bath in the second electrodeposition vessel 2116. As mentioned above, the electrodeposition bath overflown in the second electro-deposition vessel 2116 is collected to a second electrodeposition vessel overflow return port 2075, goes along a second electrodeposition vessel overflow return path 2219, passes through a second electrodeposition vessel overflow return path insulating flange 2220 and arrives at a second circulation vessel heating tank 2223. In the second circulation vessel heating tank 2223, eight second circulation vessel heaters 2224 to 2234 are provided and are made to function in initially heating an electrodeposition at room temperatures or in reheating an electrodeposition bath with a decrease in temperature by the circulation to retain the electro-deposition bath to a predetermined temperature.

To the second circulation vessel heating tank 2223, two circulation systems are connected. To be specific, they are a second electrodeposition vessel upstream circulatory reflux system returning from the second electrodeposition vessel upstream circulation jet tube 2113 to the second electro-deposition bath retention vessel 2115 via a second circulation vessel electrodeposition bath upstream circulation source valve 2232, a second circulation vessel electrodeposition bath upstream circulation pump 2234, a second circulation vessel electro-deposition bath upstream circulation valve 2237, a second circulation vessel electrodeposition bath upstream circulation flexible pipe 2238 and a second circulation vessel electro-deposition bath upstream circulation flange insulating piping 2239 and a second electrodeposition vessel downstream circulation reflex system returning from the second electro-deposition vessel downstream circulation jet tube 2114 to the second electrodeposition bath retention vessel 2115 via a second circulation vessel electrodeposition bath downstream circulation source valve 2242, a second circulation vessel electrodeposition bath downstream circulation pump 2245, second circulation vessel electrodeposition bath downstream circulation valve 2247, a second circulation vessel electrodeposition bath downstream circulation flexible pipe 2248 and a second circulation vessel electrodeposition bath downstream circulation flange insulating piping 2249. The electrodeposition bath returning from the second electrodeposition vessel upstream circulation jet tube 2113 and the second electrodeposition vessel downstream circulation jet tube 2114 to the second electrodeposition vessel 2116 is refluxed from the second electrodeposition vessel upstream circulation jet tube 2113 and the second electro-deposition vessel downstream circulation jet tube 2114 provided below the second electrodeposition bath retention vessel 2115 via orifices bored in their respective jet tubes as a jet. Reflux quantities in individual circulatory reflux systems are principally controlled by the opening of the second circulation vessel electrodeposition bath upstream circulation valve 2237 or the second circulation vessel electrodeposition bath downstream circulation valve 2247 and a finer adjustment is controlled by a second circulation vessel electrodeposition bath upstream circulation pump bypass valve 2235 or a second circulation vessel electrodeposition bath downstream circulation pump bypass valve 2244 provided at a bypass system shorting and connecting the outlet and the inlet of the second circulation vessel electrodeposition bath upstream circulation pump 2234 or the second circulation vessel electrodeposition bath downstream circulation pump 2245. The bypass system also serves to prevent the cavitation in a pump in case of a reduced reflux quantity or at the extremely vicinity of the bath temperature to its boiling point. As described also in the description of a first electrodeposition bath, the cavitation that boiling and evaporation of a bath liquid prevents the infeed of the liquid significantly shortens the service life of the pump.

In case of boring orifices in the second electrodeposition vessel upstream circulation jet tube 2113 and the second electro-deposition vessel downstream circulation jet tube 2114 to form a jet, the reflux quantity is determined almost by the pressure of the bath liquid returned to the second electrodeposition vessel upstream circulation jet tube 2113 and the second electro-deposition vessel downstream circulation jet tube 2114. A second electrodeposition vessel upstream circulation pressure gauge 2236 and a second electro-deposition vessel downstream circulation pressure gauge 2246 are provided to sense this pressure and the balance of a reflux quantity can be learned by means of these pressure gauges. Though conforming to the Bernouilli's theorem, the quantity of the reflux liquid spouted from an orifice can be made substantially constant entirely over the second electrodeposition vessel upstream circulation jet tube 2113 or the second electro-deposition vessel downstream circulation jet tube 2114 if the orifice bored in a jet tube is not greater than several millimeters in diameter. Furthermore, when the reflux quantity is sufficiently large, the exchange of a bath is very smoothly performed and accordingly a uniformed concentration and a uniformed temperature of a bath can be effectively achieved even if the second electrodeposition vessel 2116 is considerably long. Rightfully, the second electrodeposition overflow return path 2219 should be broad enough to allow this sufficient reflux quantity to flow.

The second circulation vessel electrodeposition bath upstream circulation flexible pipe 2238 and second circulation vessel electrodeposition bath downstream circulation flexible pipe 2248 provided at individual circulatory reflux systems serve to absorb strains of the respective piping systems and in particular effective for the case of using a flange insulating piping or the like in which the mechanical strength is often insufficient for a strain. The second circulation vessel electrodeposition bath upstream circulation flange insulating piping 2239 and second circulation vessel electrodeposition bath downstream circulation flange insulating piping 2249 provided at individual circulatory reflux systems serve to electrically float the second circulation vessel 2222 and the second electrodeposition vessel 2116 together with the second electrodeposition vessel overflow return path insulating flange 2220 provided midway in the second electrodeposition vessel overflow return path 2219. This is based on findings of the present inventors that eliminating the formation of an unnecessary current route prevents a stray current, thereby leading to using most of the electrodeposition current for an electrochemical film formation reaction.

Provided in a one-side circulatory reflux system is a bypass system directly returning to the second circulation vessel heating tank 2223 comprising a second circulation vessel electrodeposition bath bypass circulation flexible pipe 2250 and a second circulation vessel electrodeposition bath bypass circulation valve 2251, which is used in the case where circulation of a bath liquid is desired without reflux of the bath liquid to the second electrodeposition vessel, as is common, e.g. at the temperature elevation from room temperatures to a predetermined temperature. Besides, provided in both circulatory reflux systems from the second circulation vessel are two liquid feed systems comprising one feed to a second electrodeposition vessel inlet shower 2068 for applying an electrodeposition bath to a web directly before the second electrodeposition vessel entry roller 2069 and the other feed to second electrodeposition vessel outlet shower 2297 for applying an electrodeposition bath to the web leaving the electro-deposition vessel after passing through the second electro-deposition vessel withdrawal roller 2070. The former is linked to the second electrodeposition vessel inlet shower 2068 via the second electrodeposition vessel inlet shower valve 2241 and the latter is liked to the second electrodeposition vessel outlet shower 2297 via the second electrodeposition vessel outlet shower valve 2252. The spray amount of an electrodeposition liquid from the second electrodeposition vessel inlet shower 2068 is regulated by adjusting the opening of the second electrodeposition vessel inlet shower valve 2241, whereas that of an electrodeposition liquid from the second electrodeposition vessel outlet shower 2297 is regulated by adjusting the opening of the second electrodeposition vessel outlet shower valve 2252.

The second circulation vessel heating tank 2223, in practice, equipped with a lid, is so structured as to prevent water from being lost into a vapor. For a high bath temperature, the temperature of the lid also becomes high and consequently consideration of gluing a heat insulator or the like is necessary from the viewpoint of operation safety.

To remove the powder of the second electrodeposition vessel electrodeposition bath, a filter circulatory system is provided. The filter circulatory system for the second electrodeposition vessel comprises a second electrodeposition vessel filter circulation return flexible pipe 2253, a second electrodeposition vessel filter circulation return flange insulating piping 2253, a second electrodeposition vessel filter circulation source valve 2256, a second electrodeposition vessel filter circulation suction filter 2258, a second electrodeposition vessel filter circulating pump 2260, a second electrodeposition vessel filter circulating pump bypass valve 2259, a second electrodeposition vessel filter circulation pressure switch 2261, a second electrodeposition vessel filter circulation pressure gauge 2262, a second electrodeposition vessel filter circulating filter 2263, a second electrodeposition vessel filter circulation flexible pipe 2266, a second electrodeposition vessel filter circulation flange insulating piping 2267, a second electrodeposition vessel filter circulation valve 2268, a second electrodeposition vessel filter circulatory system electrodeposition bath midstream return valve 2270 and a second electrodeposition vessel filter circulatory system electrodeposition bath downstream return valve 2271. Along this route, the electrodeposition flows in the filter circulating directions 2257, 2264 and 2265 of the second electrodeposition vessel. The powder to be removed might jump in from outside the apparatus or might be formed on the surface of an electrode or in the bath. The minimum size of the powder to be removed is determined by the filter size of the second electrodeposition vessel filter circulating filter 2263.

The second electrodeposition vessel filter circulating filter circulation return flexible pipe 2253 and the second electrodeposition vessel filter circulation flexible pipe 2266 does not only absorb the distortion of piping to minimize the liquid leakage from the piping connection part but also protects the insulating piping having low mechanical strength to raise the disposing freedom of constituent components of the circulatory system beginning with a pump. To prevent the second electrodeposition bath retention vessel 2115 floating apart from the ground connection from falling to the ground connection, the second electrodeposition vessel filter circulation return flange insulating piping 2254 and the second electrodeposition vessel filter circulation flange insulating piping 2267 is provided for its electrical flotage. The second electro-deposition vessel filter circulation suction filter 2258 is a wire gauze like so-called "tea filter", serving to remove a large trash and protect the second electrodeposition vessel filter circulating pump 2260 and the second electrodeposition vessel filter circulating filter 2263 subsequent thereto. The second electrodeposition vessel filter circulating filter 2263 plays the principal part and serves to removes the powder mixed and generated in the electrodeposition bath. The circulation flow rate of the electrodeposition bath of this circulatory system is finely regulated principally by means of the second electrodeposition vessel filter circulation valve 2268 and supplementally by means of the second electrodeposition vessel filter circulation pump bypass valve 2259 provided in parallel with the second electrodeposition vessel filter circulating pump 2260. To grasp the circulation flow rate by these valve regulation, a second electrodeposition vessel filter circulation pressure gauge 2262 is provided. In addition to the fine regulation of the flow rate, the second electrodeposition vessel filter circulating pump bypass valve 2259 prevent occurrence of cavitation from damaging the second electrodeposition vessel filter circulating pump 2260 in case of reducing the whole flow rate of filter circulation.

The electrodeposition bath can be transported from second electrodeposition vessel drain valve 2255 to the second exhaust liquid 2274 via the second electrodeposition vessel filter circulation return flange insulating piping 2254. This transfer is carried out in the exchange of an electrodeposition bath, the maintenance of an apparatus and further an emergency. The electrodeposition bath regarded as the exhaust liquid to be transferred is dropped to a second exhaust liquid vessel exhaust liquid tank 2273 by the gravitational falling. For the purpose of maintenance and emergency, the second exhaust liquid vessel exhaust liquid tank 2273 preferably has a capacity for storing the sum of the liquid capacities of a second electrodeposition vessel 2116 and a second circulation vessel 2222. At the second exhaust liquid vessel exhaust liquid tank 2273, a second exhaust liquid vessel exhaust liquid tank upper lid 2278 is provided and a second exhaust liquid vessel air vent 2276 and a second exhaust liquid vessel air vent valve 2275 are provided to make the gravitational falling transport of an electrodeposition bath effective. After the bath temperature falls, the electrodeposition bath dropped once to the second exhaust liquid vessel exhaust tank 2273 is subjected to the waste water treatment at the building side from the second exhaust liquid vessel drain valve 2180 or collected into an unillustrated drum can via a second exhaust liquid vessel exhaust liquid collection valve 2181, an exhaust liquid collection source valve 2175, an exhaust liquid collection suction filter 2176 and an exhaust liquid collection pump 2177 and subjected to a proper disposal. Prior to the collection or the treatment, dilution with water, treatment with a medicament or the like may be performable in the second exhaust liquid vessel exhaust liquid tank 2273.

To agitate an electrodeposition so as to make uniform an electrodeposition, air bubbles are so arranged as to jet out from multiple orifices bored in the second electrodeposition vessel agitating air introduction tube 2112 provided at the bottom of the second electrodeposition bath retention vessel 2115. As the air, compressed air is taken from a compressed-air introducing port 2182, delivered via an electrodeposition bath agitating compressed air pressure switch 2183 in the direction indicated by the arrowhead of second electrodeposition vessel compressed air introducing direction 2194 and passes through a second electrodeposition vessel compressed air source valve 2195, a second electrodeposition vessel compressed air flow meter 2196, a second electrodeposition vessel compressed air regulator 2197, a second electrodeposition vessel compressed air mist separator 2198, a second electrodeposition vessel compressed air introducing valve 2199, a second electrodeposition vessel compressed air flexible pipe 2220, a second electrodeposition vessel compressed air insulating piping 2201 and a second electrodeposition vessel compressed air upstream-side control valve 2202 or a second electrodeposition vessel compressed air downstream-side control valve 2272 in sequence to the second electrodeposition vessel agitating air introduction tube 2112.

At the first electrodeposition vessel 2066 or the second electro-deposition vessel 2116, a reserve introduction system is provided so that a reserve liquid or air can be introduced. The liquid or air from an electrodeposition vessel reserve introducing port 2213 is introduced via an electrodeposition vessel reserve introducing valve 2214 and through a first electrodeposition vessel reserve introducing valve 2215 and a first electro-deposition vessel reserve introduction insulating piping 2216 to the first electrodeposition vessel and further introduced through a first electrodeposition vessel reserve introducing valve 2217 and a second electrodeposition vessel reserve introducing valve 2218 to the second electrodeposition vessel. The most possible substance introduced in the reserve introduction system is a retaining agent or a supplementary agent for keeping the capability of a bath constant for a long time, may be an air dissolved into the bath or an acid for removing the powder in some case.

Washing is carried out at the three stages comprising a pure water shower vessel, a first warm water vessel and a second warm water vessel. The arrangement of washing is such that the pure water warmed is supplied to the second warm water vessel, its exhaust liquid is used in the first warm water vessel and further its exhaust water is used in the pure water shower vessel. By this, a web is gradually washed with a higher purity water after the completion of electrodeposition in an electrodeposition vessel.

The second warm water vessel uses the purest pure water. This pure water is supplied to a second warm water vessel outlet back face pure water shower 2309 and a second warm water vessel outlet surface pure surface shower 2310 directly before the withdrawal of the web. The pure water to be supplied is delivered from a water washing system pure water port 2337 through a water washing system pure water supply source 2338, stored once in a pure water heating vessel 2339, warmed to a predetermined temperature by pure water heating vessel pure water heating heaters 2340 to 2343, passes through a pure water heating vessel pure water delivery valve 2344, a pure water heating vessel delivery pump 2346, a pure water heating vessel pressure switch 2347, a pure water heating vessel cartridge-type filter 2349 and a pure water heating vessel flow meter 2350, then partly delivered from a second warm water vessel outlet back face shower valve 2351 to a second warm water vessel outlet back face shower 2309 and the rest is delivered from a second warm water vessel outlet surface shower valve 2352 to a second warm water vessel outlet surface shower 2310. Warming is made to promote the cleaning effect. The pure water supplied to the shower and accumulated in the second warm water vessel retaining vessel 2317 forms a pure water rinse bath, in which the web is washed with still water. To keep the temperature of the pure water from declining, a second warm water vessel warm water temperature-retaining heater 2307 is provided at the second warm water vessel.

To the first warm water vessel 2361, the pure water overflown from the second warm water vessel retaining vessel 2317 is supplied from the second warm water vessel 2362 via the liking tube 2232 between the warm water vessels. As with the second warm water vessel 2262, a first warm water vessel warm water temperature-retaining heater 2304 is provided so as to retain the temperature of the pure water r. Furthermore, at the first warm water vessel 2361, an ultrasonic wave source 2306 is provided so as to positively remove the stain of the web back face between the first warm water vessel roller 2282 and the second warm water vessel shuttle entry roller 2283.

Subsequent to the pure water shower vessel pure water shower supply source valve 2323, the pure water from the first warm water vessel retaining vessel 2316 is delivered through a pure water shower vessel pure water shower supply pump 2325, a pure water shower vessel pure water shower supply pressure switch 2326, a pure water shower vessel pure water shower supply cartridge-type filter 2328 and a pure water shower vessel pure water shower supply flow meter 2329, then from a pure water shower vessel inlet surface pure water shower valve 2330 to a pure water shower vessel inlet surface pure water shower 2299, from a pure water shower vessel inlet back face pure water shower valve 2331 to a pure water shower vessel inlet back face pure water shower 2300, from a pure water shower vessel outlet back face pure water shower valve 2332 to a pure water shower vessel outlet back face pure water shower 2302, from a pure water shower vessel outlet surface pure water shower valve 2333 to a pure water shower vessel outlet surface pure water shower 2303, while cleaning shower flows are applied to the web surface and the web back face respectively at the inlet and the outlet of the pure water shower vessel 2360. The water having finished showering is received by a pure water shower vessel receiver vessel 2315, joins part of the first warm water vessel warm water retaining vessel 2316 and a second warm water vessel warm water retaining vessel 2317 and is discarded to the water washing system drainage 2336. Normally, since ions or others are contained in the cleaning finished water, a given treatment is required.

In the pure water shower vessel 2360, the first warm water vessel 2361 and the second warm water vessel 2362 for the cleaning, a web is delivered through the pure water shower vessel shuttle entry roller 2279, the pure water shower vessel roller 2280, the first warm water vessel shuttle entry roller 2281, the first warm water vessel roller 2282, the second warm water vessel shuttle entry roller 2283 and the second warm water vessel roller 2284 to the dry shuttle roller 2285. Directly after the pure water shower vessel shuttle entry roller 2279, a pure water shower vessel back face brush 2298 is provided so as to remove the relatively large grain-size powder adhered to the web back face and products weak in adhesive force.

First at the inlet of the drying section, the web having arrived at the drying section 2363 is dehydrated by means a drying section inlet back face air knife 2311 and a drying section inlet back face air knife 2312. Introduction of air into the air knife is carried out in a route comprising a drying system compressed air introducing port 2353, a drying system compressed air pressure switch 2354, a drying system compressed air filter regulator 2355, a drying system compressed air mist separator 2356 and a drying system compressed air supply valve 2357 followed by a drying section inlet back face air knife valve 2358 or a drying section inlet back face air knife valve 2359. Since especially the water content of the air supplied to the drying section is unfavorable, the role of the drying system compressed air mist separator 2356 is important.

In the subsequent step of the web transported from the dry shuttle roller 2285 to the wind-up apparatus entry roller 2286, drying by means of radiation heat of lining-up IR lamps 2313 is performed. If the radiation heat of IR lamps is sufficient, no unfavorable effect is caused even if an electrodeposition film is cast into a vacuum device such as CVD device. During the drying, generation of a mist due to the dehydration and generation of a water vapor by the IR lamp radiation takes place and the drying section vent 2314 linked with the exhaust duct is indispensable. The water vapor collected in the drying exhaust duct 2370 mostly returns to liquid water at the drying system condenser 2371 and is discarded to a drying system condenser exhaust water drain 2373 and partly to a drying system exhaust air 2374. If a harmful gas is contained in water vapor, the exhaust air should be subjected to a given treatment.

Through the wind-up apparatus entry roller 2286, a wind-up apparatus direction conversion roller 2287 and a wind-up regulating roller 2288 in sequence, the wind-up apparatus 2296 winds up the web 2006 on a web winding bobbin 2289 in the shape of a coil. If protection of the deposited layer is necessary, an interleaf is drawn out from an interleaf draw-out bobbin 2290 and wound into the web as shown in FIG. 7. The conveying direction of the web 2006 is indicated by Arrowhead 2292, the rotating direction of the web winding bobbin 2289 is indicated by Arrowhead 2293 and the wind-up direction of the interleaf draw-out bobbin 2289 is indicated by Arrowhead 2294. In FIG. 7, it is shown that no interference occurs between the web wound up on the web winding bobbin 2289 and the interleaf drawn out from the interleaf draw-out bobbin 2290 respectively at the position of conveyance start and that of conveyance end. For the purpose of dust guard, the whole wind-up apparatus is so structured as to be covered with a wind-up apparatus clean booth 2295 using a HEPA filter and a down flow.

With the apparatus shown in FIG. 7, a function of correcting the meander of a web is afforded to the wind-up apparatus direction converting roller 2287. In response to a signal from a meander detector provided between the wind-up apparatus direction converting roller 2287 and the wind-up regulating roller 2288, the wind-up apparatus direction converting roller 2287 is swung around the pivot axis set at the side of the wind-up apparatus entry roller 2286 by an hydraulic servo, thereby enabling the correction of a meander. In FIG. 7, the control of the wind-up apparatus direction converting roller 2287 is approximately the move of the roller to this side or to the inner side, whose direction is opposed to the direction of web meander detected from the meander detector. The gain of a servo depends on the conveying rate of a web, but is generally not required to be large. Even when winding up a several hundred meter long web, its end face can be aligned at a precision of sub-millimeter. The pivot axis actually employed is 2 m long to the web upstream side and is 2 m or longer toward the rollers before and behind the wind-up apparatus direction converting roller 2287, so that no ear wave occurs even if a meander correction for the end alignment is made within the width of several mm. This becomes apparent by the analysis mentioned above. Besides, use of a reflection type laser position detector for the meander detection is favorable from the viewpoint of precision.

Use of an electrodeposition bath or warm water at a higher temperature than room temperatures necessarily results in generation of a water vapor. Especially, if the used temperature exceeds 80° C., occurrence of a vapor becomes considerable. The water vapor generated from the bath surface of a vessel is accumulated on the bath surface and blows off forcefully from a gap of the apparatus, emits in a great amount at the opening or closing of a lid or flows down in water droplets from a gap of the apparatus, thus worsening the manipulating environments of the apparatus. Thus, it is advisable to forcibly suck and exhaust the water vapor via an exhaust duct. Exhaust ports linked with such exhaust ducts include a first electrodeposition vessel upstream exhaust port 2021, a first electrodeposition vessel midstream exhaust port 2022 and a first electrodeposition vessel downstream exhaust port 2023 of the first electrodeposition vessel 2066, a second electrodeposition vessel upstream exhaust port 2071, a second electrodeposition vessel midstream exhaust port 2072 and a second electrodeposition vessel downstream exhaust port 2073 of the second electrodeposition vessel 2116, a pure water shower vessel exhaust port 2301 of the pure water shower vessel 2360, a first warm water vessel exhaust port 2305 of the first warm water vessel 2361 and a second warm water vessel exhaust port 2308 of the second warm water vessel 2308. The water vapor collected at an electrodeposition vessel system and water washing vessel system exhaust duct 2020 passes through an insulating flange, mostly returns to liquid water at an electrodeposition water washing system exhaust duct condenser 2366 and is discarded to an electrodeposition water washing system exhaust duct condenser exhaust water drain 2368 and partly to an electrodeposition water washing system exhaust air 2369. If a harmful gas is contained in water vapor, the exhaust air should be subjected to a given treatment.

With the apparatus shown in FIG. 2, since the exhaust duct was made of a stainless steel, an electrodeposition water washing system exhaust duct trunk insulating flange 2365 and an electrodeposition water washing system exhaust duct water washing side insulating flange 2364 were provided to keep the first electrodeposition bath retaining vessel 2065 of the first electrodeposition bath 2066 and the second electrodeposition bath retaining vessel 2115 of the second electrodeposition bath 2116 at a float potential apart from the ground connection, so that the exhaust ducts were electrically separated from both retaining vessels.

When this apparatus was used to form an oxide on the web, however, the following inconveniences were revealed to present in the conveying system. Namely, where a meander correcting system with the web upstream side taken as the pivot was incorporated into the wind-up apparatus direction converting roller 2287 in FIG. 7, the conveyance route was almost constant without any meander and the web was wound on the web winding bobbin 2289 with the ends exactly aligned in a condition of room temperatures. Nevertheless, when the conveyance was performed with the electrodeposition bath set to a given temperature, e.g. 85° C., indeed, a web was wound on the web winding bobbin 2289 with the ends exactly aligned, but a ripple-shaped permanent deformation, or commonly-called ear wave deformation occurs on the wound web. No counter-measure was discussed about such an ear wave was discussed in the above publicly-known example or no countermeasure against this was taken.

As a result of examinations by the present inventors, this was found to be because in individual conveying rollers made in parallel with each other during room temperatures, the struts supporting an electrodeposition vessel underwent thermal deformation due to heating of the relevant electrodeposition bath and further the roller axes supported and retained by them slipped out of place. Although the capability of the winding apparatus direction converting roller 2287, into which a meander correcting system with the web upstream side taken as the pivot was incorporated, was sufficient and the end surface correction was accomplished, yet a partial deformation exceeding the yield stress led to occurrence of an ear wave.

According to Japanese Patent Application Laid-Open No. 10-194540 (Steering Apparatus and Steering Method of Strip; Sumitomo Metal, Ltd.; published on Jul. 28, 1998), a pivot and its inclination is controlled to accomplish the meander correction only by the turn roll without use of an auxiliary roll and the occurrence of an ear wave can be prevented by controlling both of them. This is based on an idea that pivoting a turn roll is inevitable to produce too long and too short routes on both sides of a web and accordingly the difference between too long and too short routes is minimized by a simultaneous inclination control for correcting their difference so as to prevent the occurrence of an ear wave. Since the ear wave put in a problem by the present inventors has already occurred apart from the correcting roller, this invention is not applicable.

Besides, after examinations were made using the apparatus shown in FIG. 2, the following inconveniences were revealed. That is, part of the film deposited on a long-scaled substrate was thinner, higher in electric resistance or generated a greater amount of microscopic protrusions due to abnormal growth than the other and such a portion was difficult to use as the optical confinement reflecting layer.

As a result of repeated examinations by the present inventors, it was confirmed that occurrence of such inconveniences originated in the non-uniformity/instability of electric current. And, causes for bringing about the non-uniformity/instability of electric current were found to lie in a poor current supply to a long-scaled substrate from a feeder roller, in other words, the non-uniformity in connection or butt between a feeder roller and a long-scaled substrate.

SUMMARY OF THE INVENTION

Hence, in consideration of the above described problem, an object of the present invention is to provide a web conveying apparatus capable of, in formation of a functional film, conveying a web, which is treated by winding in a coil shape, without occurrence of an ear wave in a predetermined speed and keeping a distance from an opposite electrode for film formation without snaking. Specifically, an electrodeposition apparatus formable at low cost does not require a rigid chamber like that of a vacuum film formation apparatus. Therefore, a part supporting a roller is adapted to be deformed by a temperature and a tension. In this case, supplying an enough conveying apparatus is important.

Another object, in consideration of the above described problem, of the present invention is to provide a continuous electrodeposition apparatus and a continuous electrodeposition method, for an oxide film, capable of flowing an even and stable electrodeposition current to electrodeposit continuously an even zinc oxide film on an elongated substrate.

Subsequently, the present invention provides a web conveying apparatus for holding and conveying a web while applying tension to the web, wherein the conveying apparatus has a plurality of rollers conveyed by contacting with the web and a mechanism for limiting deformation of the web to Y/E or smaller by at least one of the rollers, where Y is yield strength of the web and E is Young's modulus of the web.

A preferable embodiment of such web conveying apparatus exemplified by the above described mechanism is a mechanism for controling inclination of an axis of the roller having the mechanism.

In addition, one having a snaking-correction mechanism to correct snaking of the above described web and one, in which the snaking-correction mechanism comprising a displacement detection signal generating device using a laser sensor and an arc motion roller for giving a motion in direction opposite to displacement to the above described web on the basis of the displacement detection signal, are also preferable.

Further, one in which the mechanism for controlling inclination of the axis of the above described roller is a mechanism for controlling inclination of the axis by vertically moving one end of the axis and using the other end of the axis as a fulcrum, one having a inclination detection mechanism employing a noncontact sensor, one having the servo-moving mechanism having a plurality of discrete control amounts, one having the servo-moving mechanism with a continuous control amount, and one having the servo-moving mechanism and a mechanism for preventing a maximum control amount due to the servo-moving mechanism from exceeding yield stress of edges of the web are all exemplified as preferable implementations.

One having mechanism for controlling tension applied to the above described web to 0.49 N or more per 1-cm web width, and one for keeping difference between inclination of the axis of the roller having the above described mechanism for controlling the inclination of the axis of the above described roller and inclination of the axes of preceding and succeeding rollers to $^{1.025}/_{1000}$ radian or smaller are also preferable. It is further preferable that the roller having the mechanism to control inclination of the axis of the above described roller is an electrical supply roller.

Furthermore, the present invention provides the electrodeposition apparatus having the above described web conveying apparatus, an electrodeposition vessel to hold an electrodeposition bath in which electrodeposition is carried out by dipping the web, and en electrode for electrodeposition.

In addition, the present invention provides the web conveying method using the electrodeposition apparatus to hold the web and convey by applying tension to the web, wherein the electrodeposition apparatus has a plurality of rollers to be conveyed by contacting with the web and carries out conveyance by suppressing deformation in a ranfe of Y/E or less by the mechanism installed in at least one roller of the rollers.

It is preferable in such conveying method that inclination of the axis of the roller having the mechanism is suppressed by the above described mechanism.

Besides, it is preferable that conveyance is carried out by correcting snaking of the above described web by the snaking-correction mechanism and more preferable that the above described snaking-correction mechanism has the displacement detection signal generating apparatus using the laser sensor and the arc motion roller to move the arc motion roller and give the motion in direction opposite to displacement to the above described web on the basis of the displacement detection signal, are more preferable.

Further, it is also preferable implement that by the mechanism to control inclination of the axis of the above described roller, conveyance is carried out by moving the one end vertically using the other end, as the fulcrum, of the axis of the roller. It is also preferable implement that the mechanism to control inclination of the axis of the above described roller has the inclination detection mechanism employing the noncontact sensor and conveyance is carried out through monitoring inclination of the axis by the detection mechanism, the mechanism to control inclination of the axis of the above described roller has the servo-moving mechanism and the mechanism to control the maximum control amount by the servo-moving mechanism to suppress in a range of not more than the yield stress of the edges of the web are all exemplified as preferable implementations and conveyance is carried out by controlling deformation of the web to suppress in a range of not more than the yield stress of the edges of the web by these mechanisms, conveyance is carried out controlling tension applied to the above described web in a range of 0.49 N or higher per 1-cm web width, conveyance is carried out keeping the distance between inclination of the axis of the roller having the mechanism to control inclination of the above described axis of the above described roller and inclination of the axis of rollers before and after the roller to $^{1.025}/_{1000}$ radian or smaller, and conveyance is carried out controlling inclination of the axis of the electrical supply roller by the mechanism to control inclination of the axis of the above described roller.

Furthermore, the present invention provides the electrodeposition method characterized in that the web is conveyed to pass through the electrodeposition bath by the above described web conveying method and a film is formed on the web by electrodeposition.

Another embodiment of the web-conveying apparatus provided by the present invention is that the web-conveying apparatus comprising a wind-up roller for giving a driving force for conveying in a predetermined speed the web to treat by winding in the coil form and for winding up a treated web by arranging the end thereof, a delivery roller (wind-off roller) for continuously deliverying the web while holding an untreated web and applying tension to the web between the derivery roller the wind-up roller, a plurality of follower rollers for changing a travelling direction of the web, which is conveyed in a predetermined speed while the tension is kept by the wind-up roller and the delivery roller, according to treatment of the web, and a snaking-correction means for winding up the web by arranging the end thereof by the wind-up roller, wherein at least one roller of a plurality of the above described follower rollers has means for suppressing the web deformation amount caused by roller axes in a range of Y/E or less, where Y is yield strength of the web and E is Young's modulus of the web. Similar to such means, an axis inclination-controlling means to control inclination of the axis of the roller is preferable.

In the above described web conveying apparatus, it is preferable that the snaking-correction means of the web comprises the displacement detection signal generating apparatus using the laser sensor and the arc motion roller to give the motion in the direction opposite to displacement to the web on the basis of the displacement detection signal.

It is also preferable that the above described axis inclination-controlling means is the means to control inclination of the axis of the roller by moving the one end vertically using the other end, as the fulcrum, of the roller axis of the follower roller.

In addition, it is preferable that the above described axis inclination-controlling means comprises inclination detection means employing the noncontact sensor and servo-moving means having a plurality of the discrete control amount.

Or, it is preferable that the above described axis inclination-controlling means comprises inclination detection means employing the noncontact sensor and the servo-moving means having a continuous control amount.

And, it is preferable that the maximum control amount by the above described servo-moving means does not exceed the yield stress of the edges of the web.

Furthermore, the present invention provides the electrodeposition apparatus having such the web-conveying apparatus.

Another continuous electrodeposition apparatus provided by the present invention is a continuous electrodeposition apparatus in which a current is applied between a web (elongated substrate) soaked in an electrodeposition bath and an anode to deposit continuously electrochemically a film on the elongated substrate, wherein a tension is applied to the elongated substrate and the elongnated substrate is conveyed by winding a part thereof around an electrical supply roller, which feeds or receives all currents for electrodeposition through a feeding means, wherein inclination between the axis of the electrical supply roller and the axes of preceding and succeeding rollers during conveyance thereof is kept to a predetermined angle or smaller which is determined based on a ratio the yield strength to Young's modulus of the elongated substrate.

It is preferable in the above described continuous electrodeposition apparatus for the oxide film that tension applied to the elongated substrate is 0.49 N or more per 1-cm width of the substrate.

It is preferable that inclination between the axis of the electrical supply roller and the axes of preceding and succeeding rollers is kept to $^{1.025}/_{1000}$ radian or smaller.

In addition, the oxide film is preferably a zinc oxide film deposited in the electrodeposition bath containing at least a nitrate ion and a zinc ion.

The elongated substrate is preferably a metal substrate.

On the other hand, in the continuous electrodeposition apparatus for an oxide film according to the present invention, an elongated substrate to be conveyed and an anode opposite thereto are soaked in an electrodeposition bath, and a current is applied between the elongated substrate and the anode to deposit continuously an oxide film electrochemically on the elongated substrate, wherein a tension is applied to the elongated substrate, and the elongnated substrate is conveyed by winding a part thereof around an electrical supply roller, which feeds or receives all currents for electrodeposition through a feeding means, and inclination between the axis of the elecrtical supply roller and the axes of preceding and succeeding rollers during conveyance thereof is kept to a predetermined angle or smaller which is determined based on the ratio of the yield strength to Young's modulus of the elongated substrate.

It is preferable in the above described continuous electrodeposition apparatus for the oxide film that tension applied to the elongated substrate is 0.49 N or more per 1-cm width of the substrate.

Ii is preferable that inclination between the axis of the electrical supply roller and the axes of preceding and succeeding rollers is kept to $^{1.025}/_{1000}$ radian or smaller.

The oxide film is preferably a zinc oxide film deposited in the electrodeposition bath containing at least nitrate ions and zinc ions.

And, as the elongated substrate, using a metal substrate is preferable.

These preferable implementations are, needless to say, can be applied in combination under a condition not contradicted each other.

DETAILED DESCRIPTION OF THE PREFERRED EMBODIMENTS

The inventors conducted the following examinations for creating the present invention.

Figure 1A:
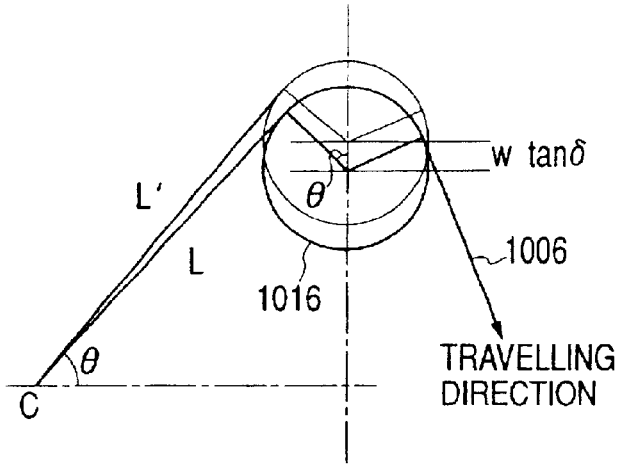
FIGS. 1A, 1B, and 1C are schematic diagrams showing a relation between the web to be conveyed and the follower roller.
Figure 1B:
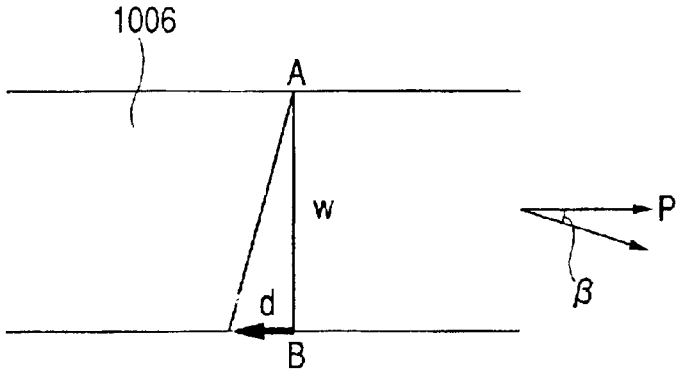
Figure 1C:
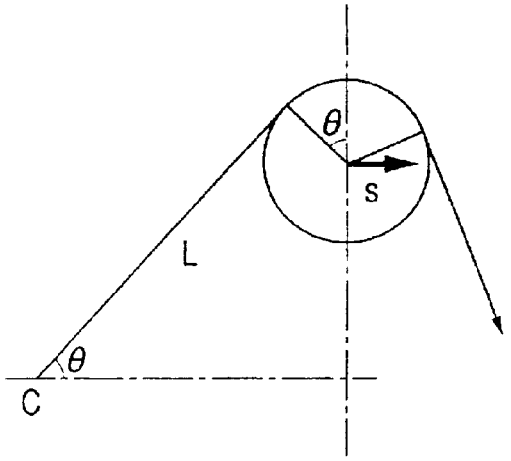

FIG. 1A shows an attitude when the axis of the roller has tilted for δ made by proceeding of the web 1006 with the width w, which has wound around the roller. A point C is a immobile point being such as the roller immediately before. Where, in the FIG. 1B showing a extended web, a side, where the roller is lifted, namely, a front side delays for d=w tanδ·sinθ and therefore, the progressing direction P of the web 1006 tilts for β. If no friction is assumed between the roller and the web 1006, the progressing direction of the web 1006, tilted causes shift of the web conveyed in the speed vd/w [mm/min] (to the front in this case) on the roller. On the other hand, as shown in the FIG. 1C, in the case where the roller axis tilts as s, treatment similar to motion like d is possible.

The above described analysis shows that in the case where the roller axis is tilted by influence of heat and tension, conveyance of the web 1006 may move to a different direction and then, that positively tilting the roller axis allows correction of the conveying web 1006 snaking.

By the way, inclination of the roller axis must not be limitlessly large. Excessively large angle causes, as readily presumable, large tension deformation causes in the web and thus, the edge exceeds the yield strength to cause permanent deformation. This phenomenon is so-called ear wave. As a result of examination by the inventors, no ear wave occurs under the following condition: for 1 roller, if it is assumed that a distance from the roller immediately before is $L_1$ and the distance up to the roller immediately after is $L_2$, and the Young's modulus is E and the yield strength of a web material is Y, the web deformation becomes $d/(L_1+L_2)$ and $$Y/E \geqq d/(L_1+L_2)$$

is held. This relation is same in lateral inclination of the roller axis. A left side is determined by material and shape of the web. On the other hand, the distance between rollers is determined at designing the apparatus. In other words, determination of the web and determination of the distance between rollers subsequently determine tolerance of deviation between roller axes. On the contrary, in order to allow deviation, the distance between rollers should be previously set to a large value. If allowable, it is possible to select an effective shape and material of the web after building up a film-forming apparatus.

If the distance between rollers can be set to the large one, or if deformation of the web can be reduced by decreasing tension applied to the web, the above requirement is relaxed. In addition, in the case where the web itself has elasticity, the requirement is not so strict.

In the above described formula, tension has been denotably included. This is because of using the yield strength Y. When one side is extended, if it is assumed that a thickness of the web is t and a width of the web is w, the maximum tension applied to a whole web becomes Ytw/2. In case of SUS with a 0.125 thickness and a 356 mm width, this value becomes about 3920 N.

In applying the above described formula, for example, in case of the SUS which the inventors attempted to try to use, it is exhibited that the Y/E value must be suppressed to deformation of about $^{1.025}/_{1000}$, namely, 1 mm for the distance of 1 m between the rollers in from and rear positions. Actually, in the apparatus shown in the FIG. 2 (FIG. 3 to FIG. 9,) the axis of the roller causes deformation of about 5 mm by thermal deformation. On the other hand, in order to keep the distance from the opposite electrode, 980 N tension is applied and thus, it was known that the ear wave is in a situation of very easy occurrence.

Further, when a shift b of the FIG. 1B exceeds a range of elastic deformation of the web (elongated substrate,) the extended side shows plastic deformation and the other side rises from the electrical supply roller, or frequently, both these phenomena simultaneously occur. The plastic deformation of the elongated substrate is inherently deformation of the substrate and therefore, not allowable by following fabrication steps for the solar cell. Besides, in such situation, it is difficult that an area around the elongated substrate is constantly kept against rotative motion of the electrical supply roller. Consequently, in such situation, feeding to the elongated substrate becomes nonuniformly. In addition, in rise of the elongated substrate from the electrical supply roller, it is evident that uniform feeding is not realized. As described above, conveyance, by which the elongated substrate is not subjected to plastic deformation, is necessary for realize uniform feeding.

On the other hand, plastic deformation does not take place, when deformation of the elongated substrate is reduced and therefore, reducing tension of the elongated substrate is one of options. However, in practice, a smaller tension causes weak collision to the electrical supply roller resulting in lower feeding to the elongated substrate. On the basis of evaluation by using the actual elongated substrate (thickness is 0.125 mm, width is 356 mm, material is SUS 430) used by the inventors, it has experimentally become evident by observation of current flowing from the electrical supply roller to the elongated substrate changing tension that 0.49 N per 1 cm width of the substrate, namely, about 17.4 N for the elongated substrate, is the minimum tension necessary for this the elongated substrate. This tension corresponds to $1/5000$ of a force necessary for plastic elongation of the whole of the elongated substrate.

By using the above described treatment, distortion (the web deformation ) is expressed as d/L. According to examination by the inventors, in order to inhibit plastic deformation, if it is assumed that the yield strength is Y and the Young's modulus is E for the elongated substrate, it is necessary that the maximum distortion does not exceed Y/E, namely, $d/L<Y/E$. On the basis of this relation, it is needed that the tolerance distortion of the elongated substrate (thickness is 0.125 mm, width is 356 mm, material is SUS 430) is $1.025/1000$. It is 0.125 mm for a 1 m L. If this tolerance distortion is generated by tilting of the electrical supply roller, deformation of a part between the electrical supply roller and the roller therebefore almost equals to deformation of the part between the electrical supply roller and the roller thereafter and hence, it is enough to consider any one of upstream and downstream rollers.

Figure 2:
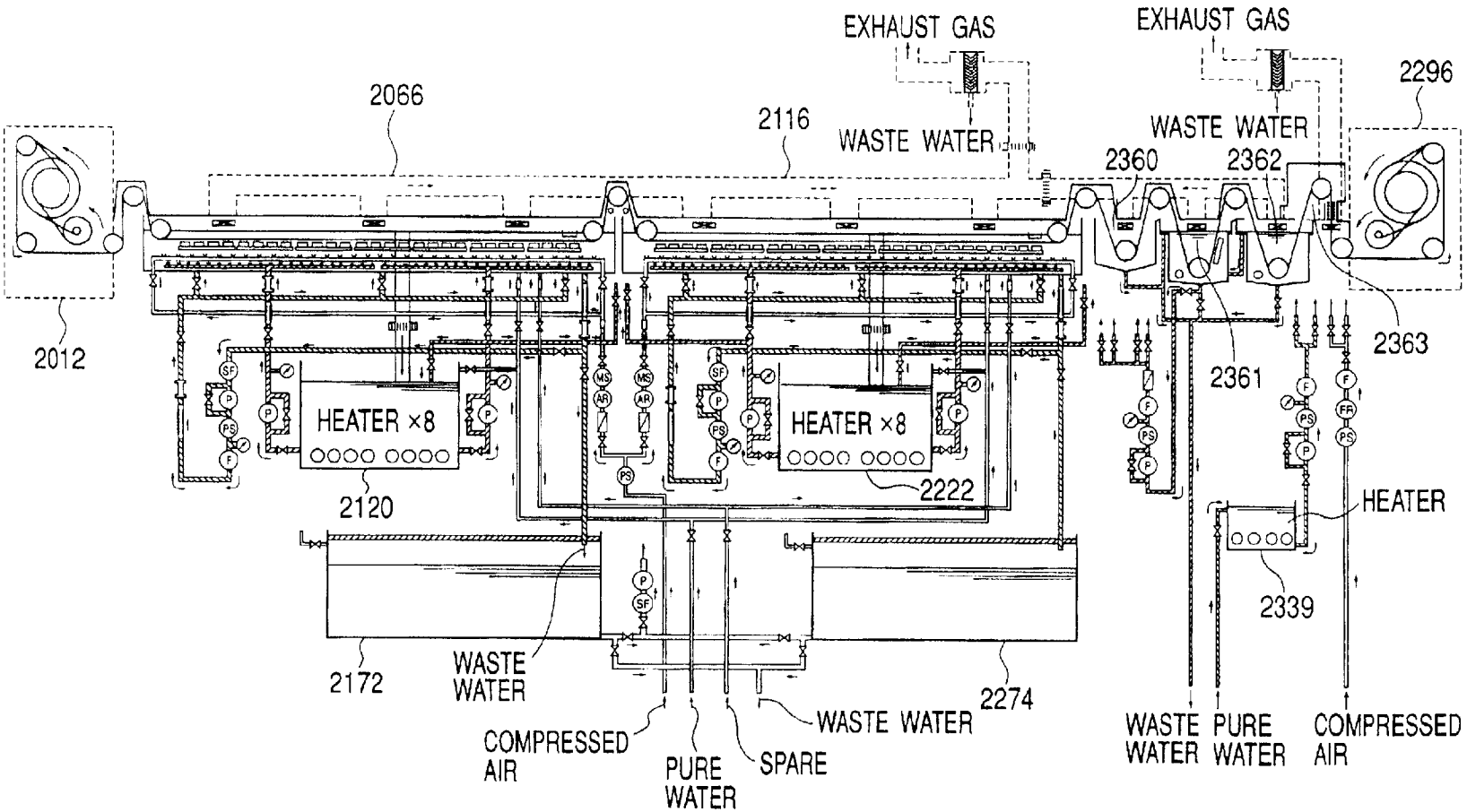
FIG. 2 is the schematic diagrams showing an example of the electrodeposition apparatus applicable of the present invention.
Figure 3:
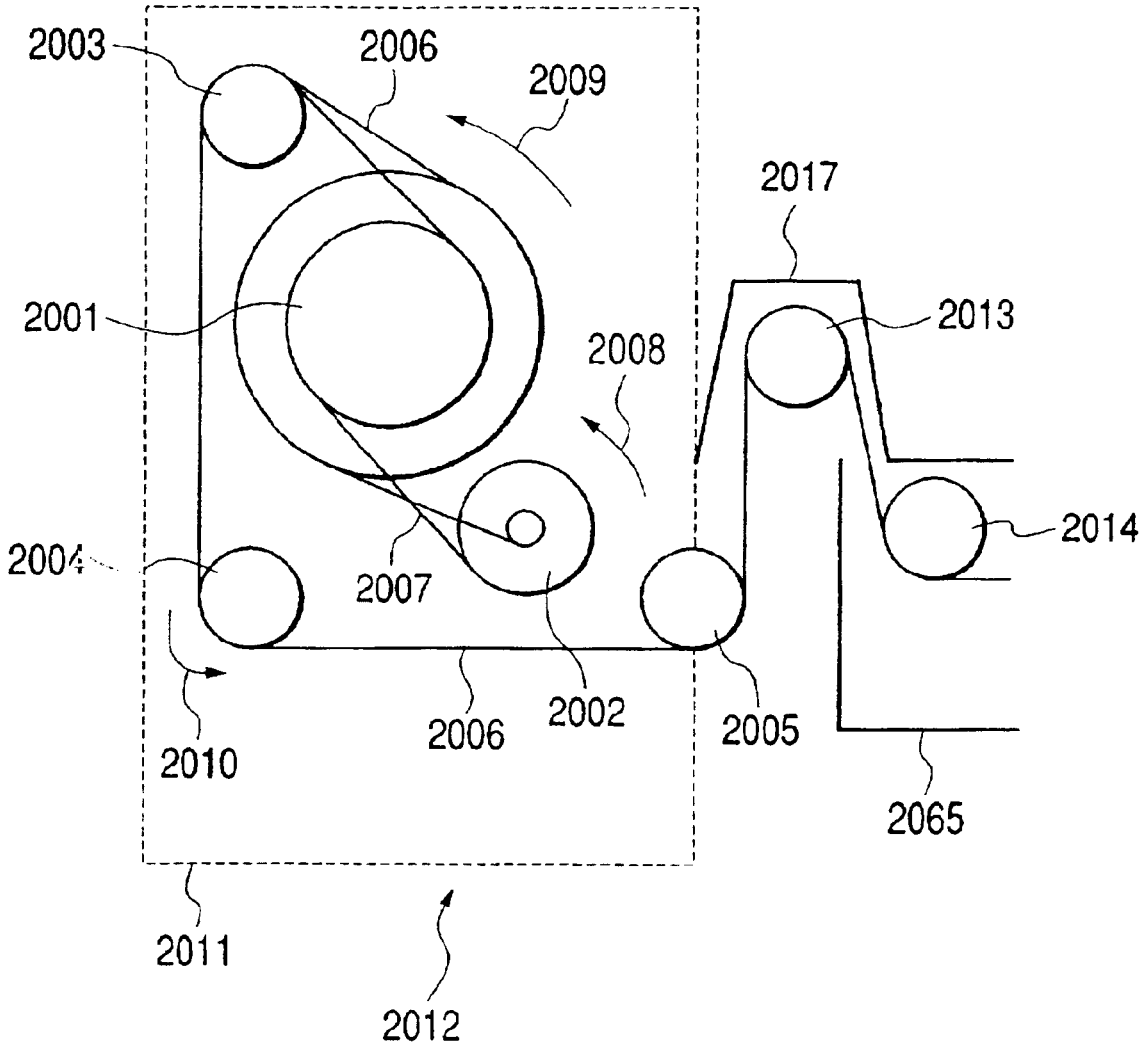
FIG. 3 is the schematic diagrams showing a wind-off apparatus in the electrodeposition apparatus applicable of the present invention.
Figure 4:
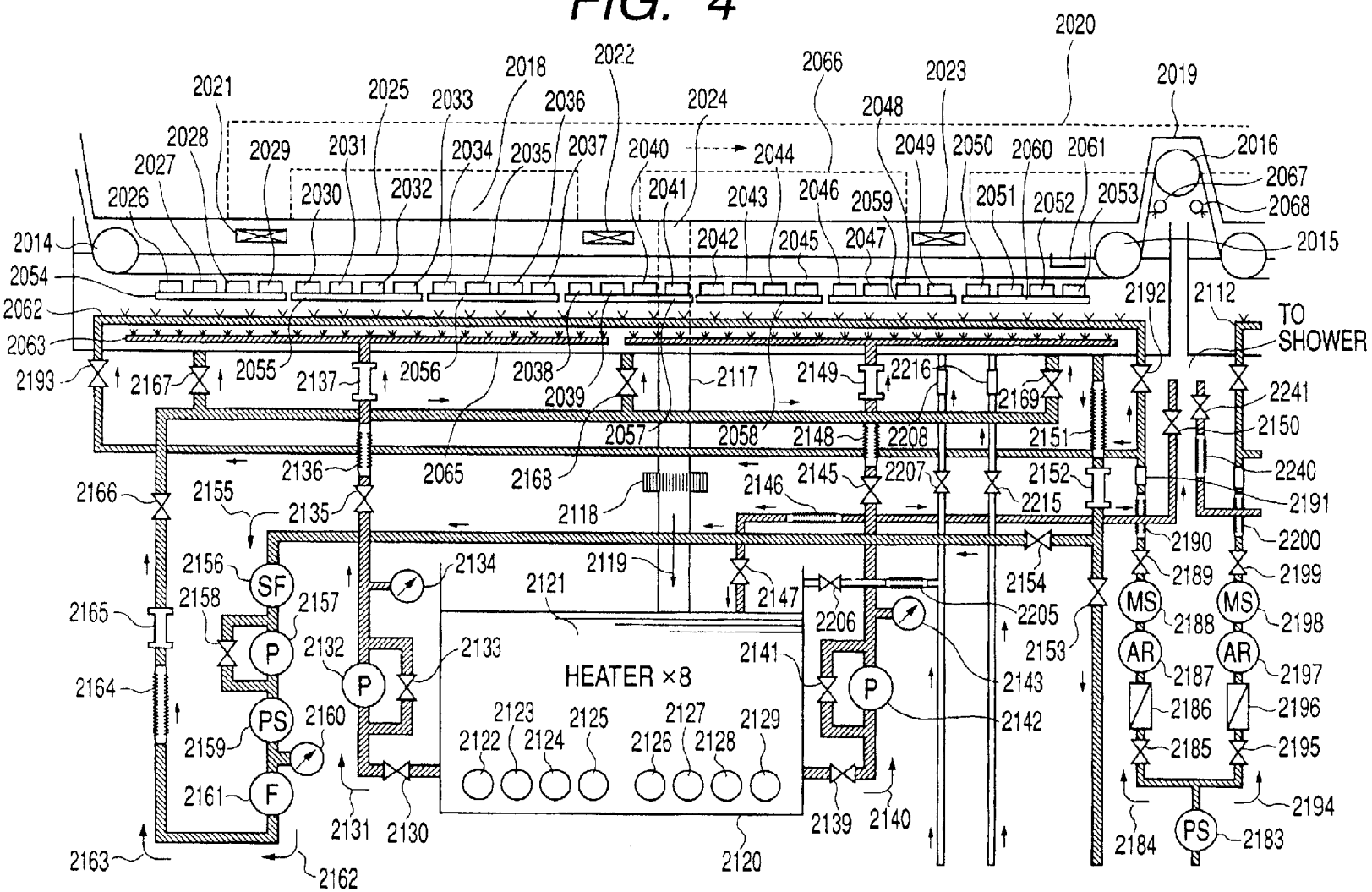
FIG. 4 is the schematic diagrams showing a first circulation vessel in the electrodeposition apparatus applicable of the present invention.

On the basis of the above examination, in the apparatus of the FIG. 2, the elongated substrate receives tension of 9800 N enough to collide against each roller to conduct a conveyance experiment. By thermal deformation of a frame of the electrodeposition vessel in accordance with rise of the temperature of the electrodeposition bath and tension deformation caused by applying tension to the elongated substrate, the axis of a turning roller 2013 in an entrance of the electrodeposition vessel generates a 1.5-m shift toward the axis of the electrical supply roller, namely, an exhaust roller 2005 of the wind-off apparatus, relatively for the width of the electrodeposition vessel, to present a large variation of a feeding current in conveyance. Hence, as described above, this may cause a small thickness of the film, a high electric resistance, and a microscopic projection due to abnormal growth.

Then, mechanical reinforcement is carried out by making the frame of a bearing part of the roller 2013 in the entrance of the electrodeposition vessel twice and concerning thermal deformation of the frame of the electrodeposition vessel in accordance with rise of the temperature of the electrodeposition bath, tension deformation caused by applying tension to the elongated substrate, and both of these, the axis of the roller 2013 in the entrance of the electrodeposition vessel is adapted to fall in a range of 1 mm shift relatively against the width of the elongated substrate for the axis of the electrical supply roller, namely, the exhaust roller 2005 of the wind-off apparatus. The distance between the axis of the roller 2013 in the entrance of the electrodeposition vessel and the axis of the electrical supply roller, namely, the exhaust roller 2005 of the wind-off apparatus was 1 m and falls in the range of the present invention. Conveying the elongated substrate in this state showed a very stable and constant feeding current In other words, in order to supply uniformly and constantly the feeding current, inclination of the axes of the electrical supply roller and rollers therebefore and thereafter is needed to keep to $1.025/1000$ (radian) or smaller.

The preferred embodiment of the web conveying apparatus according to he present invention will be described below. The present invention is not restricted to the present embodiment.

A main component of constitution of the web conveying apparatus of the present embodiment has basically similar constitution to that adopted to the electrodeposition apparatus shown in the FIG. 2 and FIG. 3 to FIG. 9. However, Various improvements have been made to solve a problem of the apparatus. Therefore, in convenience, description is given with reference numerals similar to those of the FIG. 2 and FIG. 3 to FIG. 9.

The electrodeposition apparatus, which is one of the preferred embodiment of the present invention is the apparatus to make continuously even oxide film, for example, on the web 2006 comprises the wind-off apparatus 2012 to send the web 2006, which has been wound like the coil, out, the first electrodeposition vessel 2066 to deposit or treat a first electrodeposited film, a second electrodeposition vessel 2116 to deposit or treat a second electrodeposited film, the first circulation vessel 2120 to circulate and supply the electrodeposition bath heated to the first electrodeposition vessel, the second circulation vessel 2222 to circulate and supply the electrodeposition bath heated to the second electrodeposition vessel, the first liquid exhaust vessel 2172 to store once for exhausting the electrodeposition bath of the first electrodeposition vessel, the second liquid exhaust vessel 2274 to store once for exhausting the electrodeposition bath of the second electrodeposition vessel, a filter circulation system (a piping system connected to a circulation filter 2161 of a first electrodeposition vessel filer) to clean the bath by removing powder in the electrodeposition bath in the first electrodeposition vessel, the filter circulation system (the piping system using the circulation filter 2263 of the second electrodeposition vessel filer) to clean the bath by removing powder in the electrodeposition bath in the second electrodeposition vessel, the piping system (the piping system beginning from an orifice 2182 for introducing compressed air) to send compressed air for stirring the bath respectively to the first electrodeposition vessel and the second electrodeposition vessel, the pure water shower vessel 2360 to clean the elongated substrate, on which the electrodeposited film has been deposited, by showering pure water, the first warm water vessel 2361 carrying out first cleaning by rinse with pure water, the second warm water vessel 2362 carrying out second cleaning by rinse with pure water, a pure water heating vessel 2339 to supply warm pure water necessary for these warm water vessels, the drying part 2363 to dry the web cleaned, the wind-up apparatus 2296 to wind up the web, of which film deposition has been deposited, in a coil shape again, and an exhaust system (exhaust system comprising the electrodeposition washing system exhaust duct 2020 or a drying system exhaust duct 2370) for steam generated in the heating stage or the drying stage of the electrodeposition bath and pure water.

In other words, the electrodeposition apparatus according to the present invention is that made by adopting roll-to-roll system to convey the web 2006 across rolls and for example, equipped as the main constitution component of the electrodeposition apparatus and thus, the web 2006 across rolls is flown from left to right in the FIG. 2, in order of the wind-off apparatus 2012, the first electrodeposition vessel 2066, the second electrodeposition vessel 2116, the pure water shower vessel 2360, the first warm water vessel 2361, the second warm water vessel 2362, the drying part 2363, and the wind-up apparatus 2296 to deposit a predetermined electrodeposited film.

Particularly preferable is that the elongated substrate receives tension and also is conveyed in the form of partial winding around the electrical supply roller, which feeds or receives all currents for electrodeposition through feeding means, to be conveyed and inclination of the axes of the electrical supply roller and rollers therebefore and thereafter during conveyance thereof is kept to the predetermined angle or smaller which is determined based on the ratio of the yield strength to Young's modulus of the substrate.

Each constitutional component will be described below in detail.

[Web]

The web (elongated substrate) applied to the present invention are exemplified as applicable by metal such as stainless steel (SUS), iron, copper, aluminium, and brass, or those prepared by plating on a surface of them, and also paper and resin. However, paper and resin have a large elasticity range and therefore, particularly effective in case of small distance between rollers. Basically, a constant of a material of a web material is important and a surface property does not so much influence to.

For the web (elongated substrate) electrodeposition material used for the apparatus shown in the FIG. 2, those electrically conductive to the surface of the film prepared and noncorrosive by the electrodeposition bath can be used and exemplified by metal such as stainless steel (SUS), Al, Cu, and Fe. Those coated with metal such as a PET film can be also applied. Among these materials, SUS is excellent as the elongated substrate for preparing a device in a postprocessing.

As SUS, both nonmagnetic SUS and magnetic SUS can be applied. The former is represented by SUS 304 excellent in grindability to allow making to a mirror face with about 0.1 s. The latter is represented by SUS 430 of a ferrite series, effectively used for conveyance by applying a magnetic force.

The surface of the substrate may be smooth or coarse. In rolling process for SUS, changing a kind of a rolling roller causes a change of surface properties. That called BA has a near-mirror property and 2D shows a prominent irregular surface. In either surface, observation by employing an SEM (scanning electron microscope) a microscopic hollow is occasionally found. As a solar cell substrate, rather than a large wavy irregular surface, a microscopic structure is reflected largely to characteristics of the solar cell better or worse.

In addition, in these substrates, another conductive material may be prepared as the film to select for a purpose of electrodeposition. Occasionally, forming previously a very thin layer of zinc oxide by another method is preferable for improving stably the speed of deposition by the electrodeposition method. Certainly, the electrodeposition method has a merit of a low cost. However, even if a costly method is applied additionally, when total reduction of the cost is possible, a combined use of these two systems is advantageous.

[Tension]

Tension to stretch the elongated substrate across a bobbin 2001 of the elongated substrate of the wind-off apparatus and a wind-up bobbin 2289 for the elongated substrate is assigned to 0.49 to 490 N per 1 cm substrate width. When tension is smaller than 0.49 N, the substrate is suddenly hung down, moves to outside of a predetermined conveying path, scratches an edge by moving out from the roller, or controllability of snaking correction is worsened distinctly. On the other hand, excessive tension causes expansion of the substrate itself, or there is a deviation of conveyance, as described above, only the edge elongates to make a form similar to a thallus of Undaria pinnatifida (a brown alga) or make distortion of a whole apparatus.

More preferable tension applied to the web, which is employed in the present invention, is specified by settable value selected from values ranging from around 98 N to around 1176 N for the web made of SUS of the 0.125 mm thickness and the 356 mm width. Needless to say, tension set large requires a rigid frame corresponding to the roller axis, which supports the frame. Shift of the roller axis preferably ranges from 0.1 mm to 0.3 mm or less. Better means can be adjusting the roller axis in the state of applying tension. In this case, a time sequence must be watched.

Tension can be generated by sliding of a force to wind up the wind-up bobbin 2289 for the elongated substrate and a crutch (a powder crutch and the like are effectively used) fitted to the axis of the bobbin 2001 of the elongated substrate of the wind-off apparatus. In this case, in spite of magnitude of tension, the conveying path does not almost change and intermediate rollers can be all assigned to the follower roller and therefore, freedom of designing arrangement of components, such as the roller, configuring conveyance system is very high; on other hand, at the time of no conveyance, no tension occurs and thus, for prevention of hanging down of the substrate in a still state, other lock means is necessary.

Tension can be generated also by using a tension roller and the like capable of moving the axis thereof. In this case, controlling and monitoring tension can be readily performed; however, the position of the tension roller changes and hence, the design to keep a stroke thereof is required and the degree of parallelism of the roller changes to generate snaking.

Further, tension can be generated by moving positively an intermediate roller to a direction causable of friction with the substrate. This method presents an advantage that the conveying path is not changeable and works in a stilled status. On the other hand, the material, of which dynamic friction differs greatly from static friction, does not allow easy designing.

Tension, needless to say, influences to the roller contacting with laterally rather than the roller conveyed in the form covering largely over a circumference thereof. Those expectable effects thereof are exemplified by the electrical supply roller and a snaking-correction roller as well as the wind-up roller.

[Roller]

The roller used for the apparatus shown in the FIG. 2 must satisfy functions such as determining the conveying path of the elongated substrate, and also applying an electric potential necessary for the elongated substrate, and no formation of a current stray path unnecessary.

Determination of the elongated substrate is particularly important. A degree of parallelism must be, needless to say, in an early stage is and even if the temperature of the electrodeposition bath rises to a high temperature such as 90° C. to cause thermal expansion of a large bath vessel, displacement of a position must be suppressed to a minimum degree. Practically, back lash of a submillimeter order can be allowed; however, for the parallelism, it is preferable that precision of the order of 100 minutes is kept at the time of rising of the temperature. The difference in the degree of parallelism and twist cause particularly a deviated position of the elongated substrate in the electrodeposition vessel and then, scratch and the wavy form of the Undaria pinnatifida thallus edge occurs very frequently. However, as described in examination of the present invention, in plastic deformation, distortion becomes a problem. Therefore, in case of the large distance between rollers, inclination, namely the degree of parallelism, of the roller axis is not so important cause.

If there is withy in the elongated substrate, the roller is a parallel roller and thus, surface processing is not especially necessary. However, in case of a soft substrate such as an Al foil, it is better to swell the roller in a form of a Japanese drum named crown or to make a groove for draining. In such case, tension enough for follow of the roller is not applied and therefore, to avoid it, synchronous driving of the roller brings an effect.

In order to lift electrically, the roller can be prepared with a resin such as nylon or polyethylene and also, the axis of a metal roller can be prepared with the resin, and in addition, a resin member is put between parts, where the bearing has been installed, to realize insulation.

Unless feeding to the substrate is directly carried out by a brush, or feeding is carried out through a bath, it is better to install at least 1 roller applying the electric potential and named the electrical supply roller. If the roller near the electrodeposition part is assigned to the electrical supply roller, an electric path related to an electrodeposition current can be most simply designed. In the case where a chemical substance in the bath makes a reaction by touching with the bath and then, the electrical supply roller cannot be put around the anode, such other system as brush-feeding or bath-feeding have to be considered for replacement or a combined use. This is because a resistance of the elongated substrate is about 0.01Ω a meter and therefore, when some ten ampere of electrodeposition current is used, very large thermal loss occurs.

For snaking correction, as a concept, it is better that the conveying system having almost no shift is established by making the degree of parallelism of the roller and a only small shift is corrected immediately wind-up. Correction is detected to return to the snaking-correction roller through a feed forward system or feed back system. The feed forward system, for which calculation is complicated, is relevant to a high speed system exceeding some meters per second and the feed back system, inappropriate for high speed conveyance, contributes to simplification of configuration.

In such all cases, it is preferable that the snaking-correction roller, which moves the substrate in the direction of correction, is installed. In the apparatus of the FIG. 2, a direction-switching roller 2287 (refer to the FIG. 7) for the wind-up apparatus works for such operation. Preferably, to move the substrate in the direction of correction, friction with the elongated substrate is larger. On the other hand, in order to absorb the distortion of the elongated substrate caused by correcting motion, preferably, the elongated substrate slides on the roller for snaking correction. A magnitude of friction applied practically is experimentally determined including tension. Occasionally, the effect can be yielded by selecting the material to optimize friction with the substrate and processing to make the surface coarse. In order to move the substrate in the direction of correction, configuration may be build up to allow the whole roller to move in parallel and may allow a shape (named a tangent roller) to do oscillation motion around the axis, in a certain distant position, as the fulcrum. The parallel motion roller presents the effect to the large shift and on the other hand, the tangent roller allows the simplified configuration of the apparatus.

[Supply Roller]

The material of the supply roller applied to the present invention is not restricted as long as it can hold the web, and can apply a certain tension to the web by breaking against a wind-up force of the wind-up roller, and then can control a supply speed of the web. Breaking is normally by a crutch installed coaxially in the roller. Control of the supply speed is carried out by feed back a speed, which is detected by the speed sensor and a rotation encoder, to the driving system of the wind-up roller.

[Wind-up Roller]

The preferable wind-up roller applied to the present invention is that capable of conveying wind-up of the web by motor drive, and more preferable is that capable of controlling the rotation speed by the servo. In this case, a rotation speed signal from the supply roller can be fed back. Around the wind-up roller, the web passed through a snaking correction system is wound and thus, the edge is become that arranged. It is preferable that the conveying speed of the web wound up by the wind-up roller meets a speed of 200 mm to 500s mm per minute.

[Follower Roller]

In the preferable follower roller applied to the present invention, the surface rotation precision must not exceed 1 mm to the distance of 1 m between rollers and preferably 0.3 mm or small. This is the distance including eccentric distance of the axis and hence, when a soft resin made bearing is used, this allowance may be exceeded by a temporal change. If possible, the bearing used is preferably of SUS-made or the like. The surface of the roller can be made of metal and also such resin as nylon; however, for example, the roller installed in the electrodeposition vessel is influenced by a solution, temperature, and tension and then, may cause Theological deformation beyond the allowance. Therefore, this has to be cautioned.

It is important that the surface of the roller has a somewhat large friction with the web to disturb sliding. Therefore, the surface material used is nylon and SUS. In consideration of the surface quality of the web, if sliding is easy, a stronger tension should be applied.

[Axis Inclination-controlling Means]

Axis inclination controlling means employed in the present invention is exemplified by an electric servo and a hydraulic servo or the like. Particularly, to give inclination of 1/1000 or fewer, a stroke of 1/1000 web width, i.e., normally from some ten micrometers to some hundred micrometers must be assured. Other useful system is to install a doctor guide in an upper limit and a lower limit and meet it with a top and a bottom.

In order to feed back a necessary signal for axis inclination controlling means, detection means is generally required. In this detection means, detecting the shift of the web is preferable and therefor, a laser edge position sensor and an eddy current and a magnetic sensor are applicable. The edge position of the laser sensor, even either a reflection type or a transparent type, is suitable for the case requiring precision. The eddy current sensor is preferable in the case of a limited space for installation of the sensor. The magnetic sensor presents the effect to the magnetic web.

Preferably, the shift of the web caused by these detection means is set to have precision of at least some ten micrometers, preferably from 10 to 20 micrometers. These values can be set by using the above-enumerated sensors.

[Electrodeposition Bath]

The electrodeposition bath examined by using such small experiment apparatus as beaker can be used. Concerning zinc oxide deposition having irregular surface and having optical confinement effect applied to an unlerlaying layer of the solar cell, the solution disclosed in Japanese Patent Application Laid-Open No. 10-195693 can be used. In case electrodepositing zinc oxide, a combination of zinc nitrate with an additive is preferably used and when the additive is a sugar, homogeneity of the film increases. Specifically, dextrin shows a prominent effect thereof.

In the case where the electrodeposition bath is high in temperature and generation of steam is vigorous, as shown in the FIG. 2, aspirating steam by installing a exhaust duct is preferable because exhaust of steam and water drop, made by condensation thereof, from the space in the apparatus can be prevented. In addition, when a lid not illustrated is installed in the vessel, steam dangerously blows out when the lid is removed and hence, installation of the exhaust duct is particularly recommended. In the case where a liquid volume is reduced by generation of steam by the electrodeposition bath and aspiration of exhaust, it is better to add pure water periodically.

[Condition of Electrodeposition]

For electrodeposition, negative and positive electric potentials are applied to the elongated substrate and the anode, respectively to accelerate an electrochemical reaction. In order to carry out control of the film thickness, electrodeposition by current regulation is preferable. It is preferable to designate the electric current by a density and designation is done in a range from 0.3 to 100 mA/cm$^2$.

[Anode]

As the anode, a zinc plate of purity from 2 N to 4 N can be used as a soluble anode. In the case where the surface has been contaminated, it is better to wash lightly with nitric acid. It is preferable that a feeding line to the anode is configured by tightening with a SUS bolt for assuring reliable electric contact during a long term. As an insoluble anode, SUS and Pt can be used.

Particularly, wrapping the soluble anode in an anode bag preferably prevents the generated zinc oxide powder from being dispersed into the electrodeposition bath. As the material of the anode bag, cotton and amide resin fiber noncorrosive in the bath can be used and preparing it in a proper mesh structure is preferable. The size of the mesh is determined by designating the maximum size of power, of which surface is reliably contacted with the electrodeposition bath, generate dust. Normally, the size ranging from 0.5 mm mesh to some millimeters mesh is selected.

[Electric Power Supply for Electrodeposition]

Preferably, each electric power supply has a float output. In voltage regulation, in the case where a predetermined electric potential is applied, when there is a possibility of a flow of the current to a suction direction, a suction type power supply has to be adopted. Each power supply applies the electric potential to a single or a bundled plurality of anodes to flow the current. To prevent interference between power supplies, appearance of the current path to link anodes is preferably prevented as far as possible. For this purpose, installing such insulation plate as Teflon or vinyl chloride in the bath is effective.

Examples according to the present invention will be described below.

EXAMPLE 1

Figure 10:
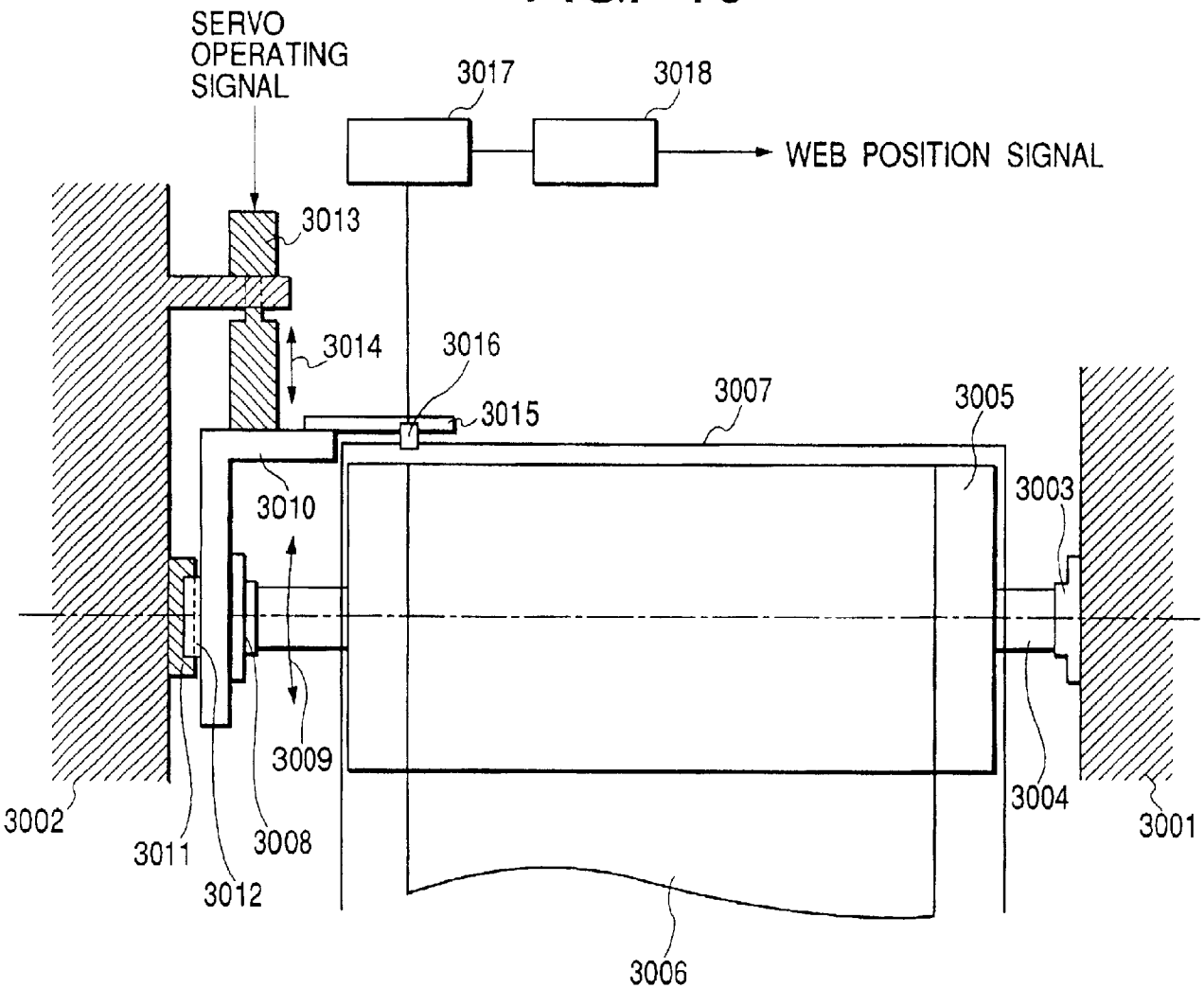
FIG. 10 is the schematic diagrams showing the example of the roller axis inclination-controlling means according to the present invention.

An ear wave-preventing apparatus according to the present invention has been assembled in a returning roller 2016 between the electrodeposition vessels of the FIG. 2. FIG. 10 shows attitude thereof.

In the FIG. 10, reference numeral 3005 denotes the returning roller 2016 (refer to the FIG. 4) between the electrodeposition vessels of the FIG. 2. In this roller 3005, the roller axis 3004 thereof is supported by the bearings 3003 and 3008. The bearing 3003 is installed in the frame of the apparatus 3001. The other bearing 3008 is installed in a bracket 3010. In the bracket 3010, a slider 3012 of an LM guide comprising the slider 3012 and a rail 3011 has been installed. The rail 3011 of the LM guide is installed in the frame 3002 of the apparatus. According to this, motion of the bracket 3010 is limited to vertical motion. Therefore, the roller axis 3004 moves similar to an arrow 3009 around the bearings 3003.

On the other hand, the bracket 3010, of which fixed end has been connected to an operation end of the electric servo 3013 installed in the frame 3002, is received a servo-working signal and gives a motion of the arrow 3014 and thus, controls inclination of the above described roller axis 3004.

Detection of a web position is carried out by an eddy current displacement sensor 3016 mounted on a sensor supporting stand 3015 connected to the bracket 3010. An output of the eddy current displacement sensor 3016 is sent to a sequencer through a sensor amplifier 3017 and an analog controller 3018 as a web position signal.

Near the roller 3005, a cover 3007 is located to prevent to escape steam from the electrodeposition bath and also prevent drying of the web, and prevent attaching of dust to the web.

Components used by the inventors are specifically recorded as follows: the eddy current displacement sensor 3016 was a sensor EX022 manufactured by KEYENCE Corporation, the amplifier 3017 was EX510 manufactured by the same corporation, and the analog controller 3018 was RDE50E manufactured by the same corporation. Advantages of the eddy current displacement sensor are installability in a small place, a good temperature characteristics, tolerability against introduced steam, and the like and preferably meets the followings: the cover is put over the returning roller 2016 between the electrodeposition vessels to inhibit to keep an enough space, the temperature of the electrodeposition bath is raised to 95° C., and steam from the electrodeposition bath may be introduced. On the basis of combination of the present sensor with the amplifier, shift of the web in the lateral direction ranging to 10 mm is converted to the voltage ranging from 0 to 10 V to output it. Resolution is 0.1 mm or higher and satisfactory for the purpose of the present invention.

The electric servo 3013 used was MSM022AIF made by Panasonic. Continuous operation is possible; however, herewith, a stopper was used to make 3-value action with ±0.3 mm (including a neutral point.) The electric servo can be made in a small size to be convenient for installation on the bracket as in the present Example. If a weight of the roller is large, the hydraulic servo can be used. As the LM guide, SR30TB made by THK Corporation was used. The stroke was enough including freeplay at installation.

Feed back of the servo by the controlling system of the sequencer comes in a center of the servo in the case, where the output from the eddy current displacement sensor is ±1 mm, and comes in just 0.3 mm of a reverse direction in exceeding 1 mm.

The above described roller axis inclination controlling system is incorporated in the electrodeposition apparatus shown in the FIG. 2 and in the state of the temperature of the electrodeposition bath being a room temperature, the web was manually set. Thereafter, tension of about 980 N was applied to the web to convey preliminarily. At this time, all the roller had completed alignment in horizontal direction. As a result of preliminary conveyance, unless the roller axis inclination controlling means according to the present invention is worked, good conveyance was yielded. Shift of the web in the part, of which snaking was corrected by using the direction-switching roller 2287 for the wind-up apparatus, fell in about ±2 mm and the web was wound in the coil form having the arranged edge of the web.

Subsequently, the temperature of the electrodeposition bath was raised to 85° C.; the electrodeposited film was deposited to carry out conveyance of the web. Then, shift of the web in the part, of which snaking was corrected by using the direction-switching roller 2287 for the wind-up apparatus, increased to about ±6 mm and thus, though snaking of the web can be corrected, the ear wave occurred and a following process did not allow it. When tension was reduced to about 588 N, shift of the web reduced to ±5 mm; however, the ear wave was inherently left unremoved.

Then, the roller axis inclination controlling means as described above as the present example was worked and then, after 10 minutes, snaking of the whole web reduced and shift of the web in the part, of which snaking was corrected by using the direction-switching roller 2287 for the wind-up apparatus, fell in about ±2 mm and as the result, the web was wound in the coil form having the arranged edge of the web.

The film electrodeposited faces to a face, in which shift is corrected by an inclination angle-controlling roller. However, the roller is the follower and the force in the direction of scratching on the film surface does not work (the web is conveyed facing closely to the roller) and therefore, crack and crush never occurred to influence to a function.

EXAMPLE 2

Figure 11:
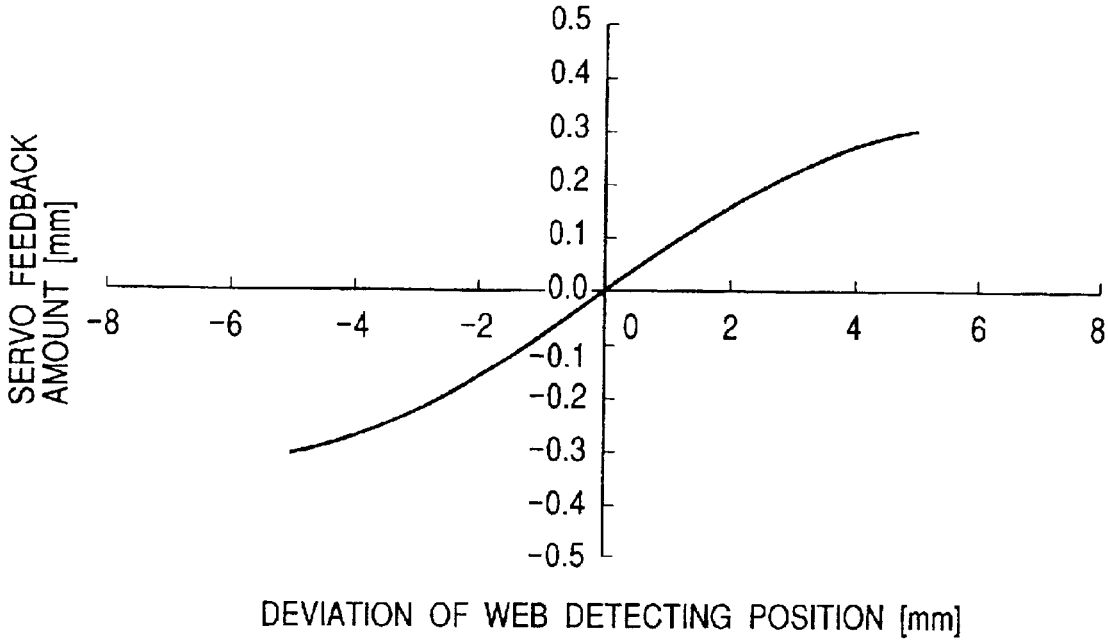
FIG. 11 is a graphical illustration showing the example of servo feedback of the axis inclination-controlling means according to the present invention.

The same control system as that incorporated in Example 1 was employed by modifying only a feed back system of the servo to a continuous system shown in the FIG. 11.

The web was set when the electrodeposition bath was in the room temperature. The preliminary conveyance showed good conveyance similar to Example 1 including wind-up without the ear wave. Next, the web conveyance was carried out after the temperature of the electrodeposition bath was raised to 85° C. and then, similar to Example 1, shift of the web in the part, of which snaking was corrected by using the direction-switching roller 2287 for the wind-up apparatus, increased to about ±6 mm. Subsequently, the roller axis inclination controlling means was worked and then, after 5 minutes earlier than Example 1, snaking of the whole web reduced and shift of the web in the part, of which snaking was corrected by using the direction-switching roller 2287 for the wind-up apparatus, fell in about ±2 mm and as the result, the web was wound in the coil form having the arranged edge of the web.

EXAMPLE 3

The same control system as that incorporated in Example 1 was incorporated in a returning forwarding roller 2279 (refer to FIG. 7) of the pure water shower vessel of the electrodeposition apparatus shown in the FIG. 2.

It is similar to Examples 1 and 2 that the preliminary conveyance was good and immediately after the temperature rise to 85° C., shift of the web in the part, of which snaking was corrected by using the direction-switching roller 2287 for the wind-up apparatus, increased to about ±6 mm. Subsequently, the roller axis inclination controlling means was worked and then, after 10 minutes, snaking of the whole web reduced and shift of the web in the part, of which snaking was corrected by using the direction-switching roller 2287 for the wind-up apparatus, fell in about ±1 mm and as the result, the web was wound in the coil form having the arranged edge of the web.

In a mode of the present example, rise and drop of the temperature of the electrodeposition apparatus is repeated and therefore, it was observed that the roller axis having been aligned to be parallel gradually changes in the time sequence. An average inclination of roller axes was about 1.5 mm to the web width. In this case, even in room temperature state of the bath, snaking of the whole web reduced and shift of the web in the part, of which snaking was corrected by using the direction-switching roller 2287 for the wind-up apparatus, fell in about ±3 mm and though the ear wave did not occur, in comparison with a state before the change in the time sequence, snaking enhanced.

Consequently, at temperature rise of the bath, correction of snaking and prevention of the ear wave is further required. Actually, in this example, when both the inclination controlling means of the present invention are turned to OFF, a part of the web is caught by an electrode frame and thus, conveyance was substantially impossible. In addition, in case where the one only was worked, shift of the web in the part, of which snaking was corrected by using the direction-switching roller 2287 for the wind-up apparatus, fell in about ±5 mm and conveyance and wind-up were possible; however, the ear wave could not removed even by reducing tension. In contrast to this, in the case where both the inclination angle-controlling measures was worked, shift of the web in the part, of which snaking was corrected by using the direction-switching roller 2287 for the wind-up apparatus, fell in about ±2 mm and preferable conveyance and wind-up were possible without occurrence of the ear wave.

EXAMPLE 4

Figure 12:
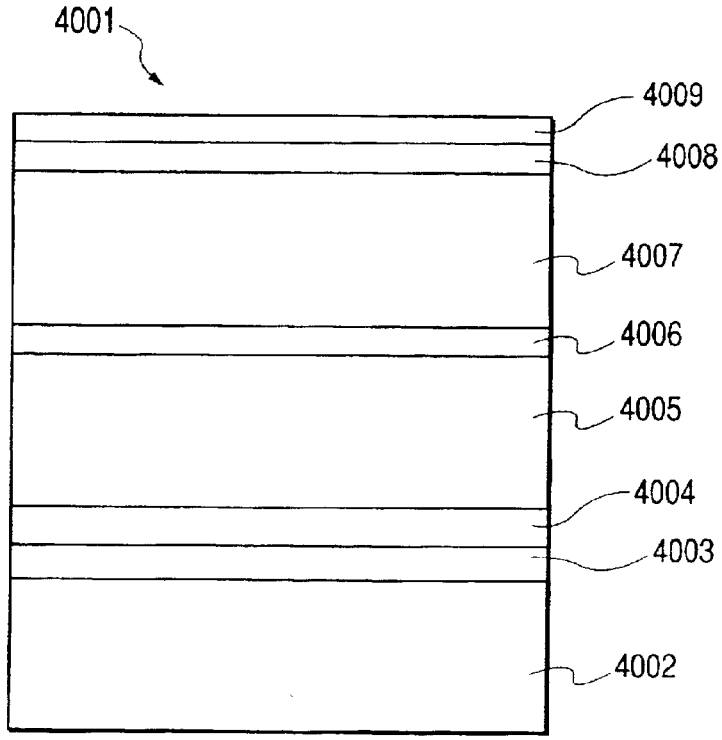
FIG. 12 is a schematically cross-sectional view of a solar cell having the oxide film fabricated according to the present invention.

By using the electrodeposition apparatus shown in the FIG. 2 (from FIG. 3 to FIG. 9,) and the present invention is applied to this to prepare the solar cell 4001 shown in the FIG. 12. In the FIG. 12, The reference numeral 4002 is the substrate, 4003 is a reflection metal layer, 4004 is a spattered zinc oxide film, 4005 is the electrodeposited zinc oxide film, 4006 is an n type layer, 4007 is an i type layer, 4008 is a p type layer, 4009 is an ITO layer.

As the substrate 4002, the elongated substrate having a 2D surface of the 0.125 mm thickness, the 356 mm width, and a 1050 m length (distortion allowance=$^{1.025}/_{1000}$) was used and using an elongated substrate-spattering apparatus not illustrated, a 2000 Å aluminium thin film 4003 and subsequently a 1700 Å zinc oxide thin film 4004 were deposited by spattering. This was set in the electrodeposition apparatus of the FIG. 2. The electrodeposition bath containing zinc nitrate of a 0.2 mol/L concentration and 0.07 g/L dextrin was circulated in a first electrodeposition vessel 2066 and a second electrodeposition vessel 2116 and kept the temperature thereof to 85° C., respectively.

In the substrate 4002 set in the electrodeposition apparatus of the FIG. 2, the conveyance speed was 500 mm/min, tension was 588 N (about 16.5 N per 1 cm substrate width) and all anode current (a sum of currents flowing in all anodes located in the first electrodeposition vessel 2066 and the second electrodeposition vessel 2116) of 176 A was fed (practically, the direction of the current is the direction from the substrate toward the electrical supply roller and hence, receiving is a correct expression; however, the anode is herewith needless to distinguish from cathode and therefore, currents of either directions are named "feeding") from the exhaust roller 2005 of the wind-off apparatus used as the electrical supply roller to electrodeposit continuously the zinc oxide film, 4005. Then, shift of the axis of the rollers before and after the electrical supply roller are both $^{0.7}/_{1000}$ or smaller and the elongated substrate showed shift of the conveying path of the maximum 2 mm, showed snaking better corrected, and wound up around an elongated substrate wind-up bobbin 2289 in a ±3mm precision.

Subsequently, the elongated substrate, on which the electrodeposited zinc oxide film 4005 was formed by such manner, was set in a elongated substrate CVD film preparing apparatus not illustrated to form sequentially and continuously a 300 Å n type amorphous silicon layer 4006, a 2000 Å i type amorphous silicon layer 4007, and a 200 Å p type microcrystal silicon layer 4008. Subsequently, using the elongated substrate-spattering apparatus not illustrated, a 660 Å ITO film 4009 was formed to yield the solar cell 3001 of the configuration shown in the FIG. 12.

The elongated substrate completed was sampled in the length direction, an output electrode was configured as the solar cell under an AM 1.5 imitation sunray to evaluate thermal conversion efficiency by IV measurement and on the basis of deviation thereof applicability of the electrodeposition layer wad evaluated by the electrodeposition apparatus of the FIG. 2. Actually, solar cell could be formed in 800 m part of the 1050 m elongated substrate, because a leader part of the apparatus is essential. The solar cell conversion efficiency was examined for this 800 m and then, almost stable production ranging from 7.5 to 7.9 percent was possible.

COMPARATIVE EXAMPLE

For comparison, as identical experimental combination to Example 1, in the status, in which shift of the roller axes before and after the electrical supply roller is $^{1.5}/_{1000}$ before reinforcing modification of an axis support of the returning roller 2013 in the entrance of the electrodeposition vessel, the solar cell of the FIG. 12 was prepared for 800 m length by the same method. For this 800 m part, the solar cell conversion efficiency was examined by a similar manner to Example 4 and then, average value raged from 7.4 to 7.9 percent. However, in a proportion of once per some ten meters, a shunt, efficiency decreased by deficiency of a current density, and the like were found. On the basis of examination by the inventors, this may be because abnormal growth and the part with a thin electrodeposited zinc oxide layer were generated on the zinc oxide film formed by the electrodeposition method using the electrodeposition apparatus of the FIG. 2. As above described, the effect of application of the present invention is evident from the comparison of Example 4 with this Comparative Example.

EXAMPLE 5

Tension of the substrate installed in the electrodeposition apparatus of the FIG. 2 (from FIG. 3 to FIG. 9) in Example 4 was increased to a range from 588 N to 980 N (about 27.5 N per the 1 cm substrate width) to prepare a similar solar cell. Shift of the exhaust roller 2005 of the wind-off apparatus, used as the electrical supply roller, from the axis of the rollers before and after the electrical supply roller were increased up to $^{1.0}/_{1000}$ and contact with the electrical supply roller of the substrate showed further improved reliability for that length. By this, the solar cell for 800 m length shown in the FIG. 12 was prepared through the process same as Example 4.

The solar cell conversion efficiency for 800 m was 7.6 to 8.0 percents somewhat increased than Example 4. From examination of IV characteristics, this is caused by short current density Jsc improved. In the electrodeposition apparatus shown in the FIG. 2, tension increased for the elongated substrate caused stable state of the distance between anode substrates for a long period on the basis of almost no influence by stirring of the bath for a long time. Therefore, stable formation of the electrodeposited zinc oxide film was realized.

EXAMPLE 6

Thickness of the SUS substrate used was increased to the range from 0.125 to 0.15 mm. This is for a main purpose to increase independence as the solar cell. However, a size of the coil restricted the length allowing formation of the solar cell film to 600 m.

At this time, deformation allowance, namely, allowance of shift of the axis of rollers before and after the electrical supply roller, according to the present invention does not change. Changeable is tension causing the same change. In other words, the present example requires 1176 N tension not 980 N to bring the same deformation of the substrate as that of Example 5. Increase in tension causes a larger deformation of the roller axis. However, increase in rigidity of the frame supporting the axis is not realistic and therefore, the distance between rollers was let meet the range from 1m to 1.5 m. According to this, the maximum distortion fell in $^{0.8}/_{1000}$ and did not exceed the predetermined Y/E.

Figure 5:
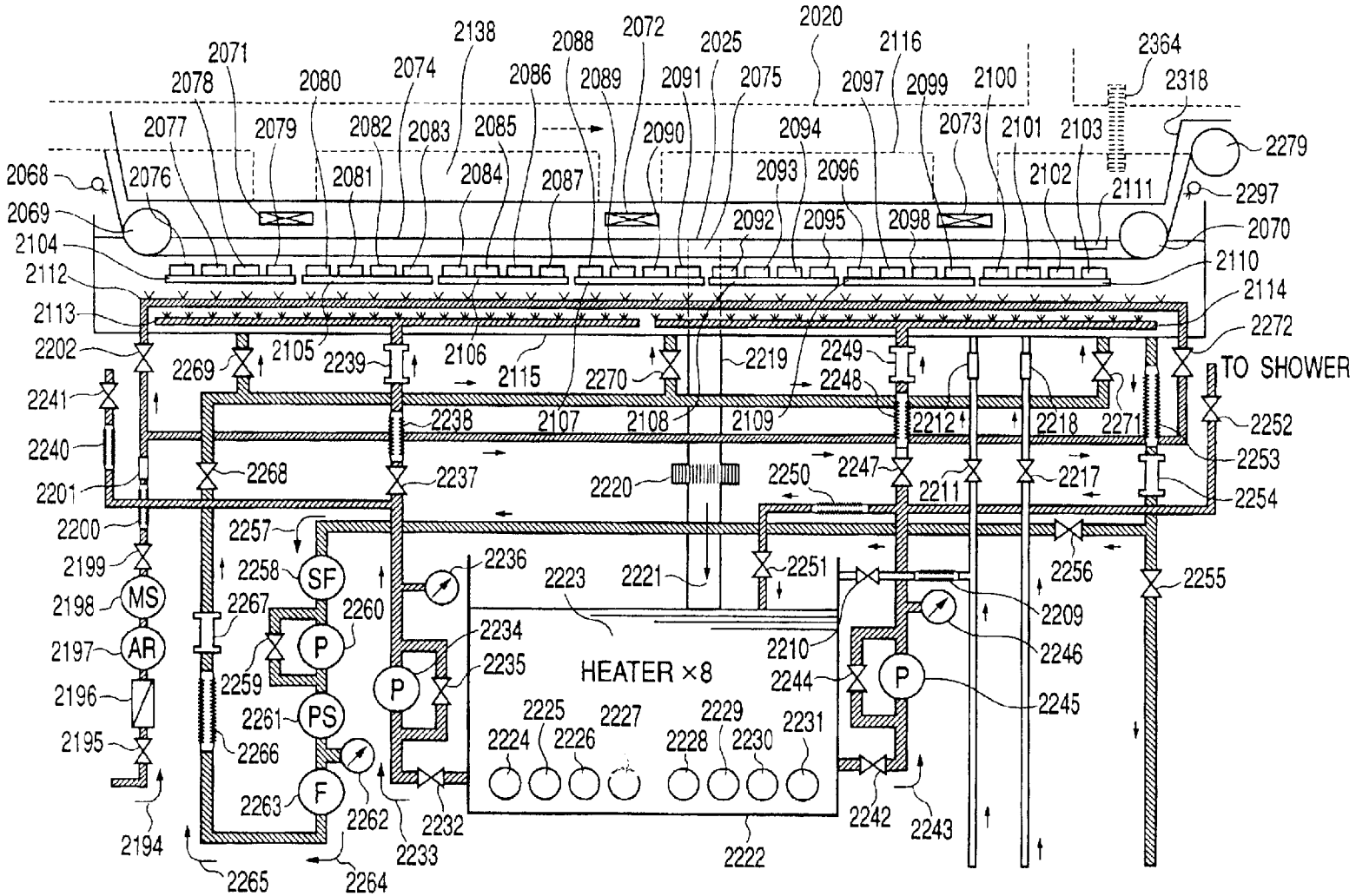
FIG. 5 is the schematic diagrams showing a second circulation vessel in the electrodeposition apparatus applicable of the present invention.
Figure 6:
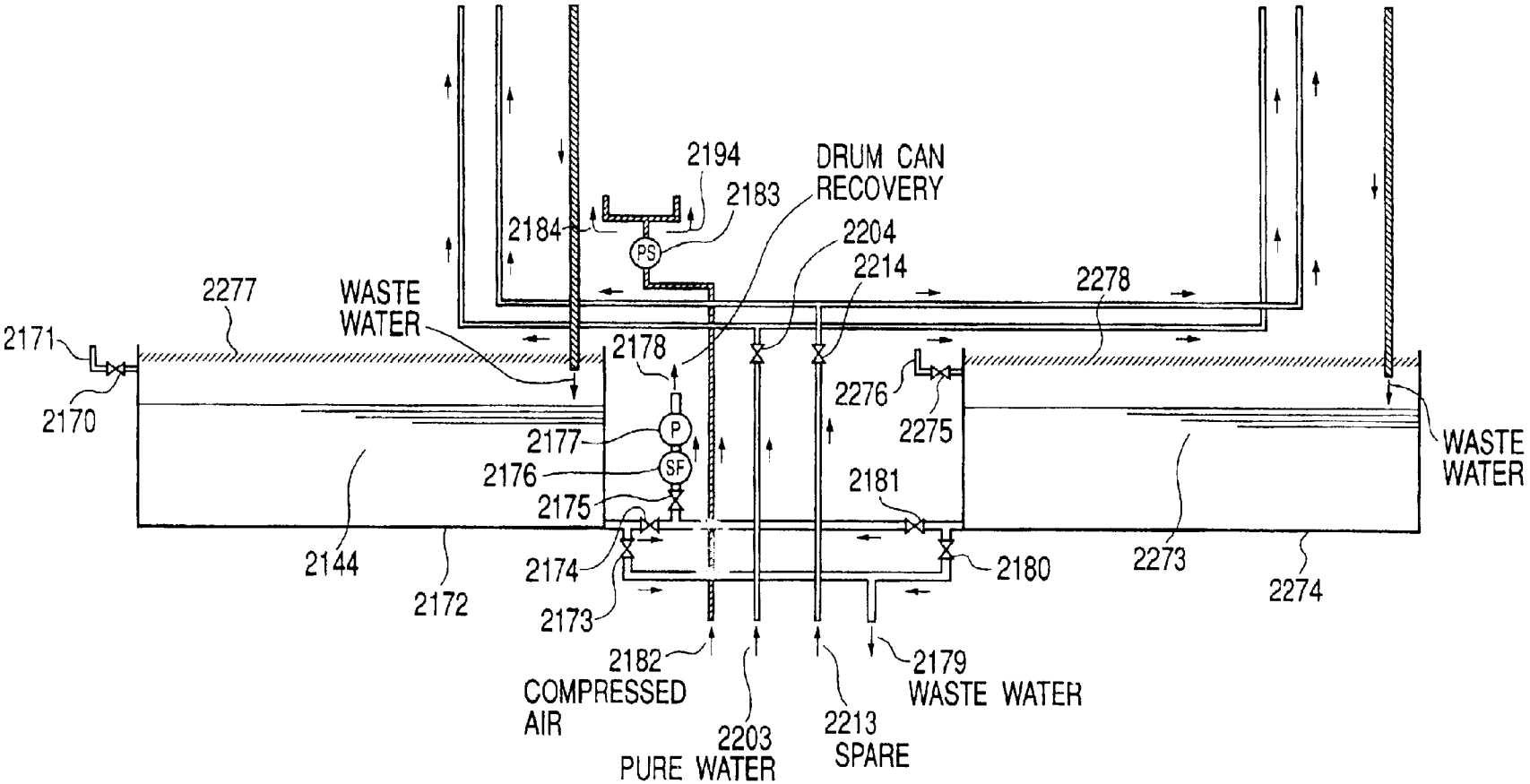
FIG. 6 is the schematic diagrams showing a first liquid exhaust vessel and a second liquid exhaust vessel in the electrodeposition apparatus applicable of the present invention.
Figure 7:
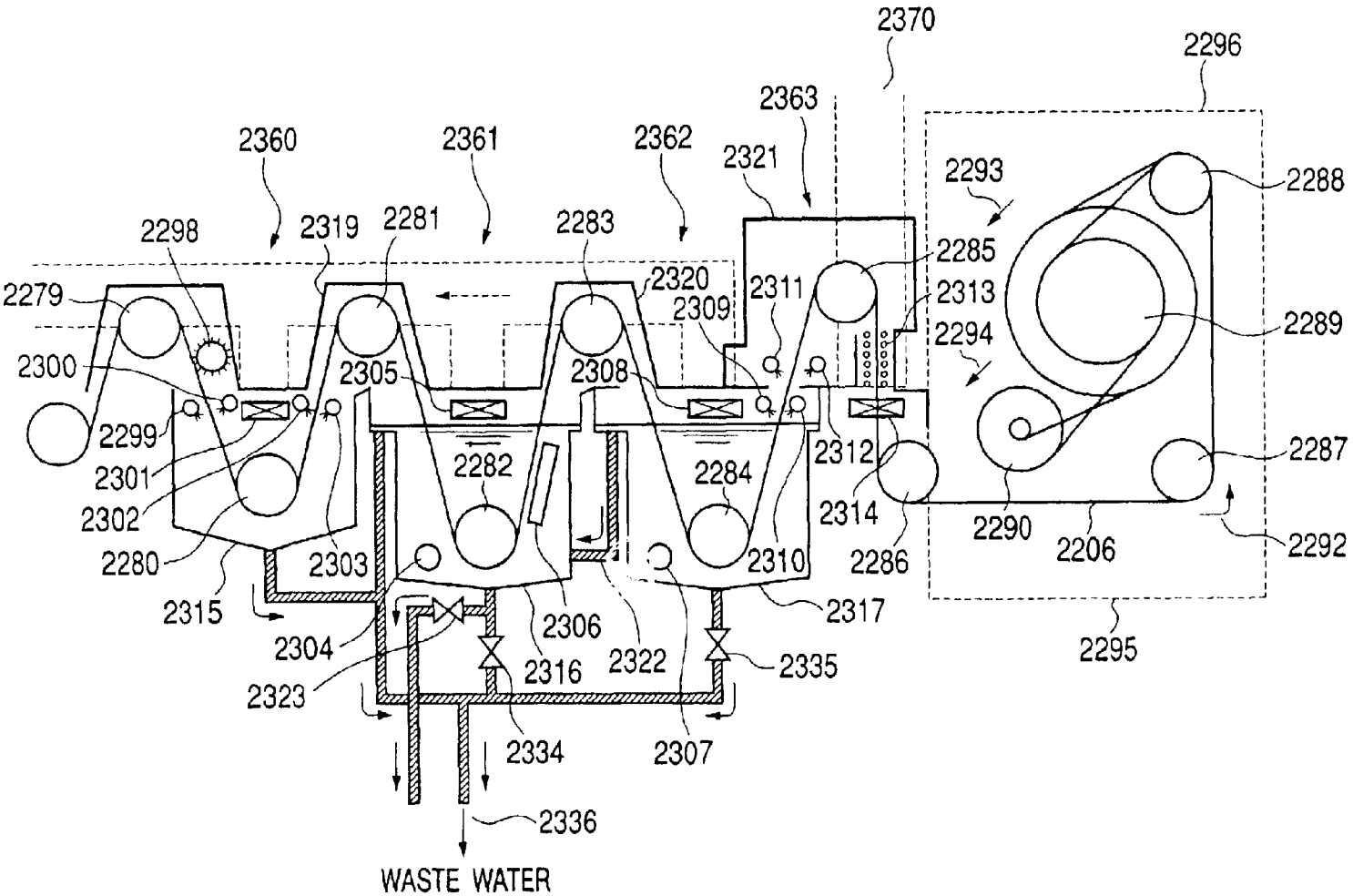
FIG. 7 is the schematic diagrams showing a pure water shower vessel, a first warm water vessel, a second warm water vessel, a drying apparatus, and wind-up apparatus in the electrodeposition apparatus applicable of the present invention.
Figure 8:
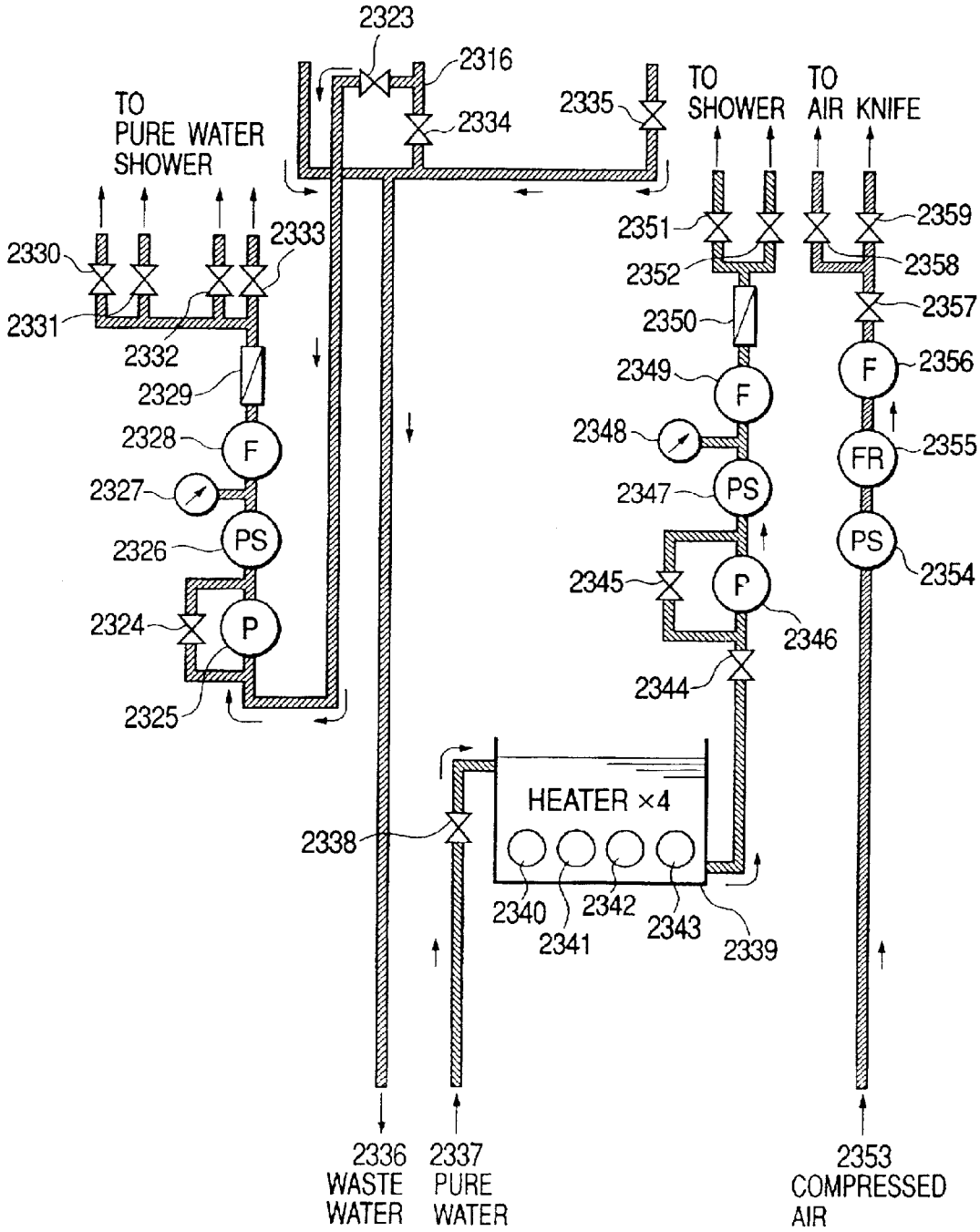
FIG. 8 is the schematic diagrams showing a pure water-heating vessel and the like in the electrodeposition apparatus applicable of the present invention.
Figure 9:
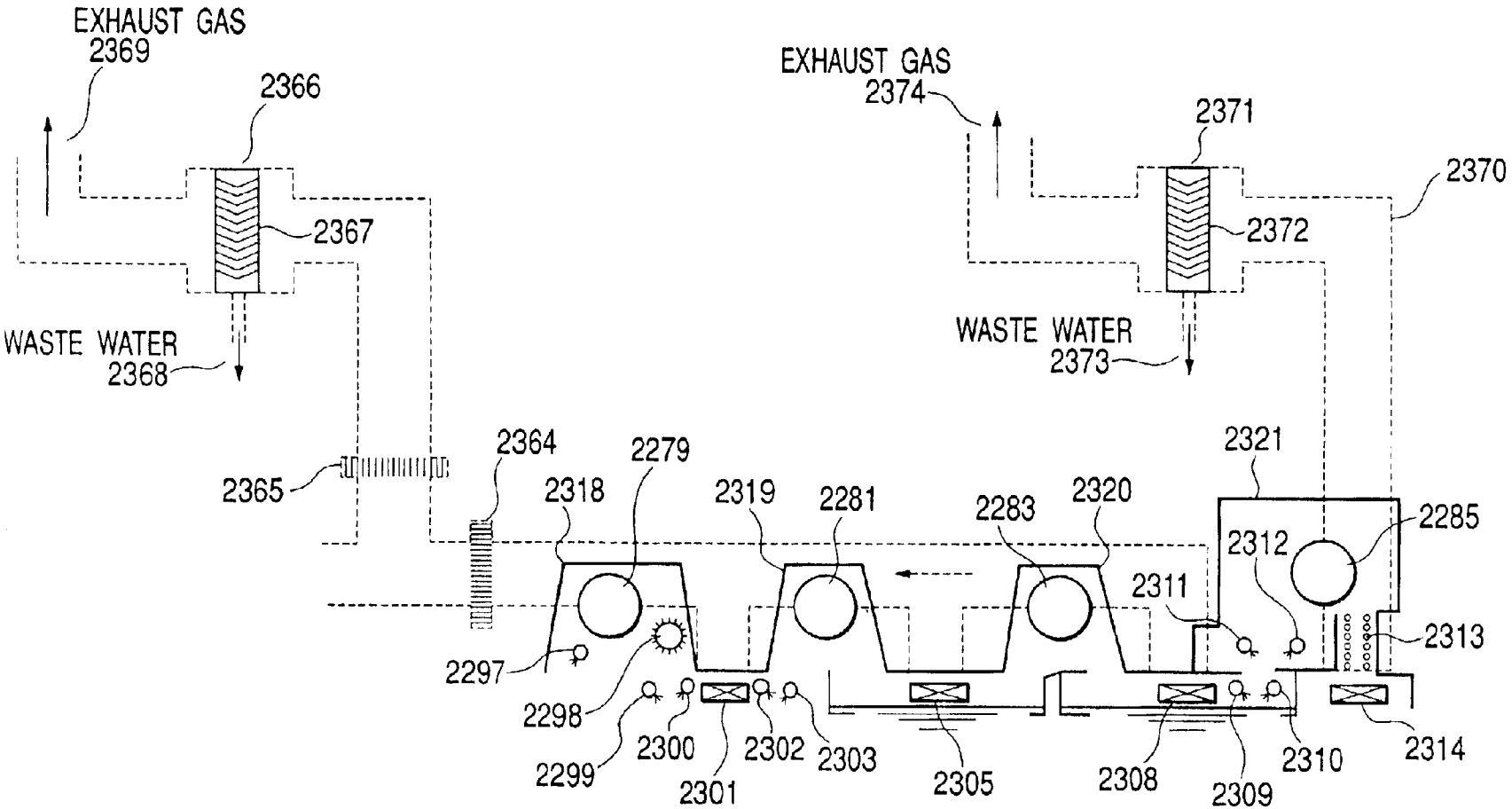
FIG. 9 is the schematic diagrams showing a water exhaust system in the electrodeposition apparatus applicable of the present invention.

Conveying the elongated substrate, set according to the above described method, was very preferably carried out and formed the solar cell shown in the FIG. 12, similar to the FIG. 5. Evaluation of conversion efficiency for 600 m showed 7.7 to 8.0 percents, which is a value more stabilized than Example 2. This is because the substrate becomes withy and hence, a mechanical precision was improved for the opposite electrodes as like as the electrodeposition apparatus shown in the FIG. 2.

As described above, according to the web conveying apparatus according to he present invention, as described in analysis and examples, in forming the functional film, the conveyance system, by which the web to be treated in a wound form like the coil can be conveyed in the predetermined speed, without the ear wave, keeping the distance from a film-forming opposite electrode, and without snaking, can be provided in the form capable of incorporation in the film-fabricating apparatus.

On the other hand, this system has the snaking correction means and the inclination control means of the arc motion roller and thus, even if inclination of the roller axis occurs according to the temperature change, tension change, and temporal change, the conveying system capable of wind-up the web, without the ear wave and snaking, can be provided.

In addition, the servo feed back controls the noncontact sensor and a plurality of discrete control amounts and therefore, the detection part can be installed in a smaller space and also a simple algorithm realizes control.

Further, by controlling a consecutive feed back amount by the servo feed back, a response time from shift of the web to return to the predetermined path can be made short.

And, the maximum control by the inclination control means does not exceed the yield stress of the edge of the web and therefore, the ear wave is not caused by the inclination control means According to the present invention, the zinc oxide film allowing flow of the current for electrodeposition to the elongated substrate uniformly and stably, without occurrence of abnormal growth, and uniform film thickness and electric resistance can be continuously electrodeposited.

Also according to the present invention, application of tension of 0.49 or higher a 1 cm width of the elongated substrate allows preventing rise up of the elongated substrate from the electrical supply roller and allows preventing occurrence of reduction, caused by no flow of the current, of the film thickness. Consequently, the uniform zinc oxide film can be electrodeposited continuously across the length direction of the elongated substrate.

Furthermore, the present invention can, by making inclination of the axis of the electrical supply roller and the rollers therebefore and thereafter $^{1.025}/_{1000}$ (radian) or smaller, make an area around the electrical supply roller in both sides of the elongated substrate uniform, the uniform current can be kept across a width direction of the elongated substrate, and therefore, the zinc oxide film uniform in the width direction can be electrodeposited continuously.

What is claimed is:

1. A web conveying apparatus for conveying a web while holding the web and applying tension to the web, wherein the conveying apparatus comprises a plurality of rollers with which the web contacts to be conveyed, and at least one roller of the rollers comprises a mechanism for controlling inclination of an axis of the roller having the mechanism to limit deformation of the web to Y/E or less, where Y is yield strength of the web and E is Young's modulus of the web.

2. The web conveying apparatus according to claim 1, comprising a meandering correction mechanism that corrects meandering of the web.

3. The web conveying apparatus according to claim 2, wherein the meandering correction mechanism comprises a displacement detection signal generator for generating displacement detection signal with laser sensor and an arc motion roller that provides the web an motion opposite to displacement of the web based on the displacement detection signal.

4. The web conveying apparatus according to claim 1, wherein the mechanism for controlling the inclination of the axis of the roller is a mechanism for controlling the inclination of the axis by moving upward or downward one end of the axis of the roller with supporting other end of the axis of the roller.

5. The web conveying apparatus according to claim 1, wherein the mechanism for controlling the inclination of the axis of the roller has an inclination detection mechanism with a non-contact sensor.

6. The web conveying apparatus according to claim 1, wherein the mechanism for controlling the inclination of the axis of the roller has a servo motion mechanism with a plurality of discrete control amounts.

7. The web conveying apparatus according to claim 1, wherein the mechanism for controlling the inclination of the axis of the roller has a servo motion mechanism with continuous control amounts.

8. The web conveying apparatus according to claim 1, wherein the mechanism for controlling the inclination of the axis of the roller has a servo motion mechanism and a mechanism for preventing a maximum control amount due to the servo motion mechanism from exceeding yield stress of edges of the web.

9. The web conveying apparatus according to claim 1, wherein the tension applied to the web is controlled such that it is 0.49N or more for 1 cm of the web width.

10. The web conveying apparatus according to claim 1, further comprising a mechanism for maintaining difference in inclination between the axis of the roller having the mechanism for controlling the axis of the roller and axes of preceding and succeeding rollers within $^{1.025}/_{1000}$ radian.

11. The web conveying apparatus according to claim 1, wherein the mechanism for controlling the inclination of the axis of the roller is an electrical supply roller.

12. An electrodeposition apparatus comprising a web conveying apparatus according to any one of claims 1 or 2–11, an electrodeposition vessel holding a electrodeposition bath in which electrodeposition is performed with the web being immersed, and an electrode for the electrodeposition.

13. A web conveying method comprising using an apparatus for conveying a web while holding the web and applying tension to the web, wherein the conveying apparatus comprises a plurality of rollers with which the web contacts to be conveyed, and the web is conveyed while deformation of the web is limited to Y/E or less by a mechanism provided for at least one roller of the rollers, where Y is yield strength of the web and E is Young's modulus of the web.

14. The web conveying method according to claim 13, wherein inclination of an axis of the roller having the mechanism is controlled by the mechanism.

15. The web conveying method according to claim 13, wherein the web is conveyed with the web meandering being corrected by a web meandering correction mechanism.

16. The web conveying method according to claim 15, wherein the meandering correction mechanism comprises a displacement detection signal generator for generating displacement detection signal with laser sensor and an arc motion roller, and the web is conveyed with the mechanism providing the web an motion opposite to displacement of the web by moving the arc motion roller based on the displacement detection signal.

17. The web conveying method according to claim 14, wherein the web is conveyed while the mechanism for controlling the inclination of the axis of the roller moves upward or downward one end of the axis of the roller with supporting other end of the axis of the roller.

18. The web conveying method according to claim 14, wherein the mechanism for controlling the inclination of the axis of the roller has an inclination detection mechanism with a non-contact sensor, and the web is conveyed with the detection mechanism monitoring the inclination of the axis.

19. The web conveying method according to claim 14, wherein the mechanism for controlling the inclination of the axis of the roller has a servo motion mechanism and a mechanism for preventing a maximum control amount due to the servo motion mechanism from exceeding yield stress of edges of the web, and the web is conveyed with these mechanisms such that the stress of the web edges do not exceed the yield stress.

20. The web conveying method according to claim 14, wherein the web is conveyed while the tension applied to the web is controlled such that it is 0.49N or more for 1 cm of the web width.

21. The web conveying method according to claim 14, wherein the web is conveyed while difference in inclination between the axis of the roller having the mechanism for controlling the axis of the roller and axes of preceding and succeeding rollers is maintained within $^{1.025}/_{1000}$ radian.

22. The web conveying method according to claim 14, wherein the web is conveyed while the mechanism for controlling the inclination of the axis of the roller controls inclination of an axis of an electrical supply roller.

23. An electrodeposition method comprising conveying a web by a web conveying method according to any one of claims 13 to 22 such that the web passes through an electrodeposition bath, and depositing a film on the web by electrodeposition.

24. A web conveying apparatus comprising:

a wind-up roller for providing driving force to convey a web handled in coil form at a predetermined speed and winding up a processed web with alignment of edges of the web;

a delivery roller for continuously delivering the web with holding an unprocessed web and applying tension to the web between the wind-up roller and the delivery roller;

a plurality of follower rollers for converting a traveling direction of the web conveyed at the predetermined speed, tension of which is maintained between the wind-up roller and the delivery roller; and a meandering correction direction means for allowing the wind-up roller winding up the web with edge alignment, wherein at least one roller of the plurality of follower rollers is provided with an axis inclination control means for controlling an axis of the roller while limiting deformation of the web between the rollers to Y/E or less, where Y is yield strength of the web and E is Young's modulus of the web.

25. The web conveying apparatus according to claim 24, wherein the meandering correction mechanism comprises a displacement detection signal generator for generating displacement detection signal with laser sensor and an arc motion roller that provides the web an motion opposite to displacement of the web based on the displacement detection signal.

26. The web conveying apparatus according to claim 24, wherein the axis inclination control means is means for controlling the inclination of the axis of the follower roller by moving upward or downward one end of the axis of the follower roller with supporting other end of the axis of the follower roller.

27. The web conveying apparatus according to claim 24, wherein the axis inclination control means comprises an inclination detection means with a non-contact sensor and a servo motion means with a plurality of discrete control amounts.

28. The web conveying apparatus according to claim 24, wherein the axis inclination control means comprises an inclination detection means with a non-contact sensor and a servo motion means with continuous control amount.

29. The web conveying apparatus according to claim 24, wherein the axis inclination control means comprises a servo motion means, and a maximum control amount due to the servo motion means does not exceed yield stress of edges of the web.

* * * * *

UNITED STATES PATENT AND TRADEMARK OFFICE

CERTIFICATE OF CORRECTION

PATENT NO. : 6,752,915 B2
DATED : June 22, 2004
INVENTOR(S) : Kozo Arao et al.

It is certified that error appears in the above-identified patent and that said Letters Patent is hereby corrected as shown below:

Title page,
Item [56], References Cited, FOREIGN PATENT DOCUMENTS,

| | | |
|---|---|---|
| "5270710 | should read -- | 5-270710 |
| 6239508 | | 6-219508 |
| 8197124 | | 8-197124 |
| 10296317" | | 10-296317 --. |

Column 37,
Line 24, "an" should read -- a --;
Line 63, "1 or" should read -- 1-11, --; and
Line 64, "2-11," should be deleted; and "a" should read -- an --.

Column 38,
Line 21, "an" should read -- a --.

Column 39,
Line 18, "an" should read -- a --.

Signed and Sealed this

Seventh Day of December, 2004

JON W. DUDAS
*Director of the United States Patent and Trademark Office*